US008177117B2

(12) United States Patent
Little

(10) Patent No.: US 8,177,117 B2
(45) Date of Patent: May 15, 2012

(54) MATERIALS FOR AND METHOD FOR MANUFACTURING CONTAINER WITH CORNER SUPPORTS AND RESULTING CONTAINER

(75) Inventor: Troy Little, Thomasville, PA (US)

(73) Assignee: York Container Company, York, PA (US)

( * ) Notice: Subject to any disclaimer, the term of this patent is extended or adjusted under 35 U.S.C. 154(b) by 527 days.

(21) Appl. No.: 12/323,821

(22) Filed: Nov. 26, 2008

(65) Prior Publication Data

US 2009/0286663 A1 Nov. 19, 2009

Related U.S. Application Data

(63) Continuation-in-part of application No. 12/121,414, filed on May 15, 2008, now Pat. No. 7,819,305.

(51) Int. Cl.

| | |
|---|---|
| ***B65D 5/50*** | (2006.01) |
| ***B65D 25/04*** | (2006.01) |
| ***B31B 7/00*** | (2006.01) |
| ***B31B 17/00*** | (2006.01) |

(52) U.S. Cl. ..... 229/120.18; 229/122.32; 229/199; 493/89; 493/94; 493/96; 493/907

(58) Field of Classification Search ..... 229/120.18, 229/122.32, 122.33, 199, 918, 919; 206/774; 493/89, 94, 96, 907

See application file for complete search history.

(56) References Cited

U.S. PATENT DOCUMENTS

| | | | | |
|---|---|---|---|---|
| 499,654 | A | 6/1893 | Clark | |
| 959,261 | A | 5/1910 | Reber | |
| 2,002,618 | A | 5/1935 | Sutter | |
| 2,134,964 | A | 11/1938 | Whitehead | |
| 2,148,533 | A | 2/1939 | Chapman | |
| 2,766,923 | A | 10/1956 | D'Esposito | |
| 2,771,986 | A | 11/1956 | Bekoff | |
| 2,884,179 | A | 4/1959 | Rossum | |
| 2,894,672 | A | 7/1959 | Bamburg | |
| 2,903,176 | A | 9/1959 | Crane | |
| 2,922,552 | A | 1/1960 | Berger et al. | |
| 2,939,620 | A | 6/1960 | Royce | |
| 3,017,064 | A | 1/1962 | Davis | |
| 3,034,698 | A | 5/1962 | Forrer | |
| 3,048,318 | A | 8/1962 | Sabin | |
| 3,155,234 | A | 11/1964 | Knoll et al. | |
| 3,236,433 | A | 2/1966 | Barrett | |
| 3,373,921 | A | 3/1968 | Crane | |
| 3,397,831 | A * | 8/1968 | Adams | 229/122.32 |
| 3,696,990 | A | 10/1972 | Dewhurst | |
| 3,765,044 | A | 10/1973 | Hanahan et al. | |
| 3,912,159 | A | 10/1975 | Danville | |
| 3,982,684 | A | 9/1976 | David | |
| 4,056,223 | A | 11/1977 | Williams | |
| 4,058,249 | A | 11/1977 | Buck | |

(Continued)

FOREIGN PATENT DOCUMENTS

FR 2641758 7/1990

*Primary Examiner* — Gary Elkins

(74) *Attorney, Agent, or Firm* — Barnes & Thornburg LLP

(57) ABSTRACT

In accordance with the invention, a method of manufacturing containers and resulting containers and associated pre-assemblies and blanks are provided, which, when utilized, result in containers that have increased side panel strength and corner strength so as to enable effective vertical stacking of containers when the containers include product.

25 Claims, 36 Drawing Sheets

U.S. PATENT DOCUMENTS 4,068,796 A * 1/1978 Kullman, Jr. ..... 229/191
4,197,980 A 4/1980 Johnson
4,403,729 A 9/1983 Wytko
4,605,158 A 8/1986 Barton
4,874,125 A 10/1989 Bates
4,927,073 A 5/1990 Esposito
4,961,500 A 10/1990 Coulombe
5,213,220 A 5/1993 McBride
5,294,044 A 3/1994 Clark
5,315,936 A 5/1994 Smith
5,350,109 A 9/1994 Brown et al.
5,375,715 A 12/1994 Serre et al.
5,400,955 A 3/1995 Coalier et al.
5,415,345 A 5/1995 MacKinnon
5,505,368 A 4/1996 Kanter et al.
5,520,325 A 5/1996 Quaintance
5,673,848 A 10/1997 Garza
5,791,555 A 8/1998 Kanter
5,853,120 A 12/1998 McLeod et al.
5,947,292 A 9/1999 Chelfi
5,957,294 A 9/1999 Kanter
5,975,413 A 11/1999 Moen
5,979,746 A 11/1999 McLeod et al.
6,015,084 A 1/2000 Mathieu et al.
6,068,140 A 5/2000 Mangrum et al.
6,085,969 A 7/2000 Burgoyne
6,138,904 A 10/2000 Baird et al.
6,158,653 A 12/2000 Kanter et al.
6,189,778 B1 2/2001 Kanter
6,189,780 B1 2/2001 Kanter
6,270,007 B1 8/2001 Jensen, Jr.
6,325,282 B1 12/2001 Kanter et al.
6,513,705 B1 2/2003 Sheffer
6,712,214 B1 3/2004 Wintermute et al.
6,719,191 B1 4/2004 Christensen et al.
6,817,514 B2 11/2004 Kanter et al.
6,868,968 B1 3/2005 Casanovas
6,874,679 B2 4/2005 Tibbles et al.
6,948,617 B2 9/2005 Kanter et al.
6,962,558 B2 11/2005 Dalrymple
7,066,379 B2 6/2006 McLeod et al.
7,290,696 B2 11/2007 McClure
7,819,305 B2 * 10/2010 Little ..... 229/122.32
2005/0161496 A1 7/2005 McLeod et al.
2005/0189258 A1 9/2005 Vastola
2005/0242164 A1 11/2005 Teixidor Casanovas
2006/0060643 A1 3/2006 Sheffer
2006/0124712 A1 6/2006 Weimer, Jr.
2006/0196920 A1 9/2006 Moen
2007/0108261 A1 5/2007 Schuster
2007/0187346 A1 8/2007 Markson et al.
2008/0169339 A1 7/2008 Moser
2008/0169340 A1 7/2008 Sheffer
2008/0265726 A1 10/2008 Sheffer
2010/0083618 A1 4/2010 Little

* cited by examiner

MATERIALS FOR AND METHOD FOR MANUFACTURING CONTAINER WITH CORNER SUPPORTS AND RESULTING CONTAINER

CROSS-REFERENCE TO RELATED APPLICATION

This application is a continuation-in-part of prior U.S. patent application Ser. No. 12/121,414, filed on May 15, 2008 now U.S. Pat. No. 7,819,305, the entirety of which being incorporated herein by reference. The invention relates in general to the manufacture of packaging/containers that may be readily used to transport product and/or display the contents of the containers following delivery, as specified in the independent claims.

BACKGROUND OF THE INVENTION

Various packages and containers are conventionally provided for transporting product to and storing product in a retail environment and for display to prospective customers. As is conventionally known in the packaging industry, such containers can be transported to manufacturing and/or retail environments for display in knock-down form, i.e., flattened but otherwise being glued, stapled or otherwise affixed or joined together, such that they are already substantially pre-assembled; in such a knock-down state, personnel assembling the container need only open the sides and or ends of the container and affix the container bottom wall into its assembled condition. As a result, such final assembly may be performed prior to loading manufactured product. Alternatively, such final assembly may be performed such that the product can be placed into a resulting assembled container for ready display.

Conventionally, it has been deemed advantageous at times to stack a plurality of such containers, one on top of the other, for the purposes of transport to a retail environment or during display in the retail environment. In this use, it is necessary that the containers stacked above the bottom-most container are amply supported and also that a stack of a number of such containers, when loaded with product, will not collapse.

SUMMARY

The following presents a simplified summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to the more detailed description below.

In accordance with illustrated embodiments, a method of manufacturing containers and resulting containers and associated pre-assemblies and blanks are provided, which, when utilized, result in a container that has increased side panel strength and corner strength so as to enable effective vertical stacking of containers when the container includes product.

Additionally, in accordance with some illustrated embodiments, the manufactured container provides the dual use of both a transporting container for transporting product to a retail environment and a display container configured to display the product in that retail environment.

BRIEF DESCRIPTION OF THE DRAWINGS

Various embodiments are described herein, by way of example only, with reference to the accompanying drawings.

With specific reference now to the drawings, it should be understood that the particulars shown are by way of example and for purposes of discussion of illustrated embodiments only, and are presented in order to provide what is believed to be a useful and readily understood description of the principles and concepts of the invention. In this regard, no attempt is made to show structural details of the invention in more detail than is necessary for a fundamental understanding of the illustrated embodiments, the description taken with the drawings making apparent to those skilled in the art how the several illustrated embodiments of the invention may be embodied in practice.

Accordingly, a more complete understanding of the present invention and the utility thereof may be acquired by referring to the following description in consideration of the accompanying drawings, in which like reference numbers indicate like features, and wherein:

FIG. 1 illustrates a side perspective view of a container manufactured in accordance with an illustrated embodiment.

FIG. 2 illustrates a top view of the package illustrated in FIG. 1.

FIG. 3 illustrates an example of a primary blank used in manufacturing the container of the type illustrated in FIG. 1.

FIG. 4 illustrates another example of a primary blank used in manufacturing the container of the type illustrated in FIG. 1.

FIG. 5 illustrates an example of a supplementary blank used in manufacturing the container of the type illustrated in FIG. 1.

FIG. 6 illustrates a side perspective view of the finally assembled illustrated in FIG. 1 with additional detail.

FIG. 7 illustrates a functional block diagram used to describe the manufacturing method of container pre-assemblies in accordance with an illustrated embodiment FIG. 8 illustrates a side perspective view of another container manufactured in accordance with an illustrated embodiment.

FIG. 9 illustrates an example of a primary blank used in manufacturing the container of the type illustrated in FIG. 8.

FIG. 10 illustrates another example of a supplementary blank used in manufacturing the container of the type illustrated in FIG. 8.

FIG. 11 illustrates the pre-assembly materials for the container of the type illustrated in FIG. 8 in a first stage of pre-assembly.

FIG. 12 illustrates the pre-assembly materials for the container of the type illustrated in FIG. 8 in a second stage of pre-assembly.

Figure 8:
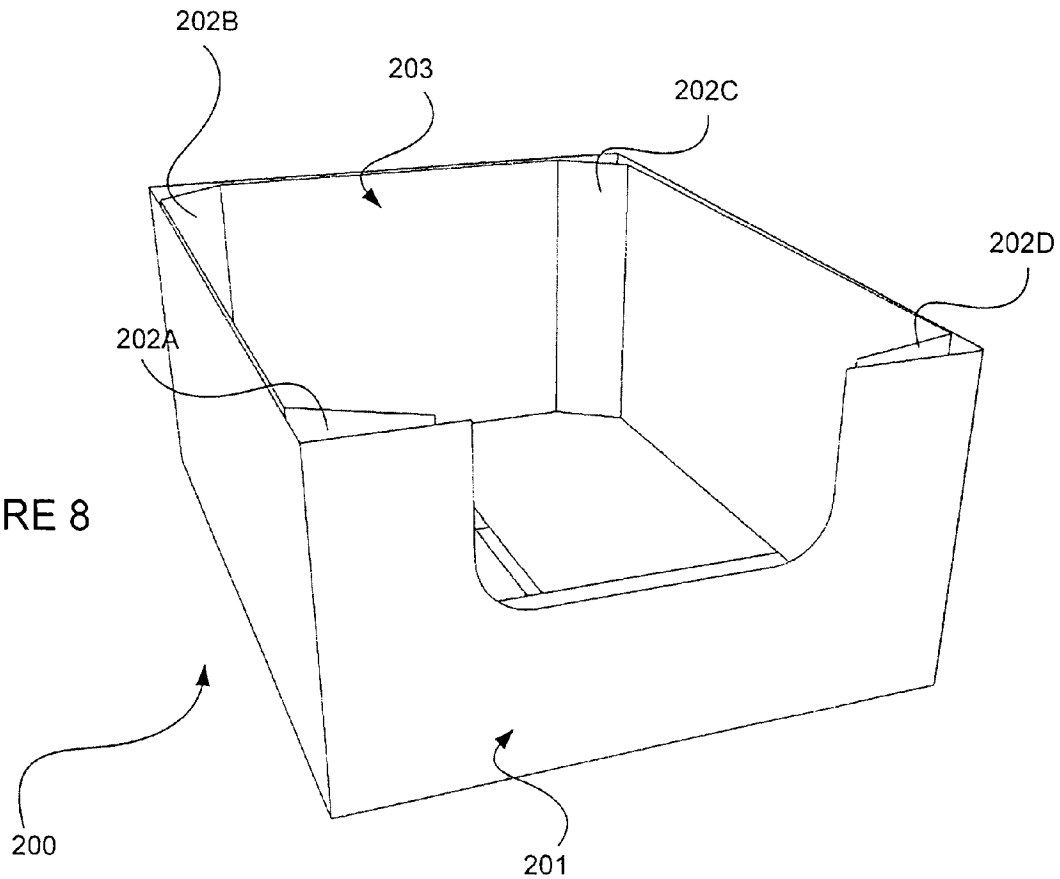
Figure 13:
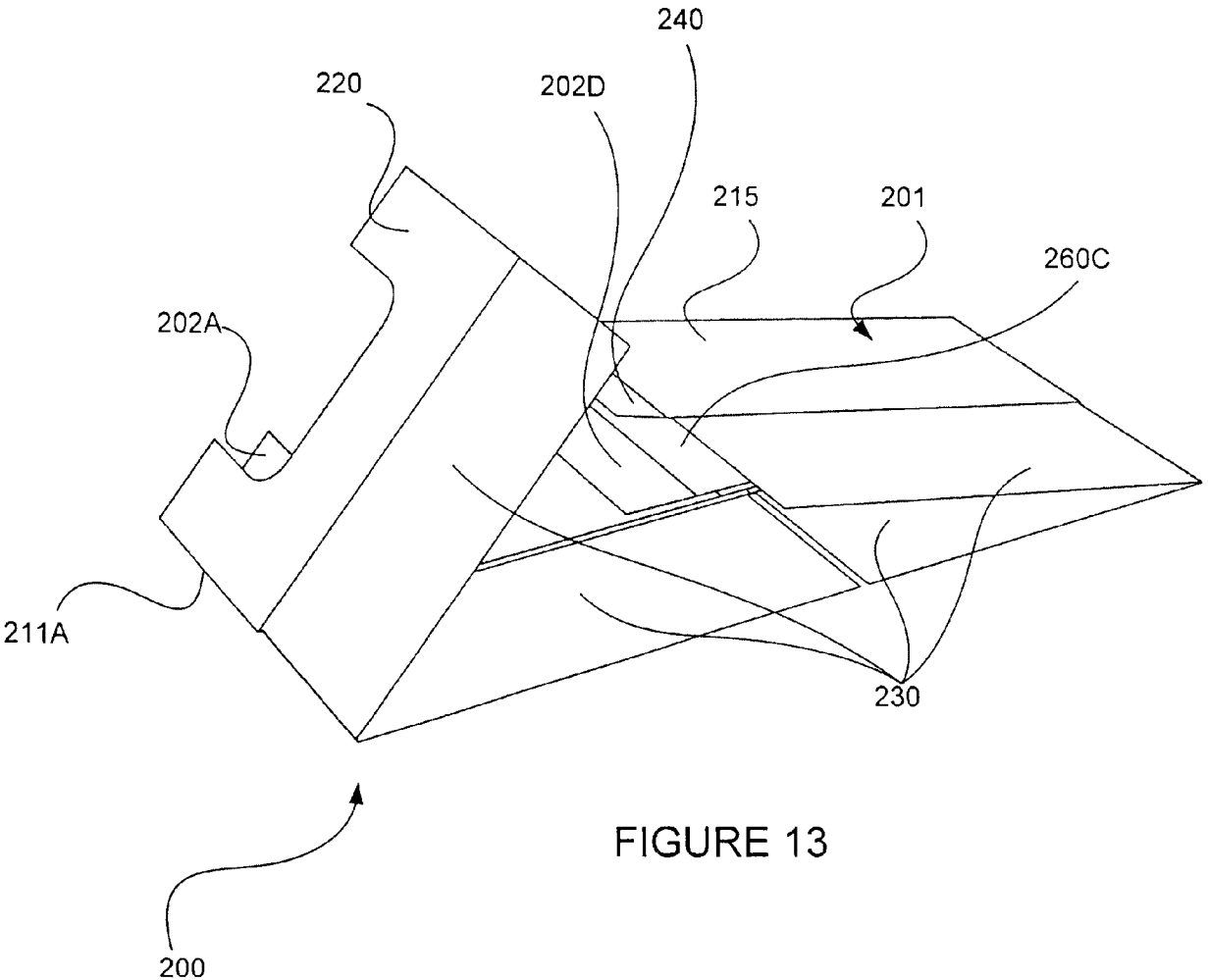

FIG. 13 illustrates the pre-assembly materials for the container of the type illustrated in FIG. 8 in a third stage of pre-assembly.

Figure 14:
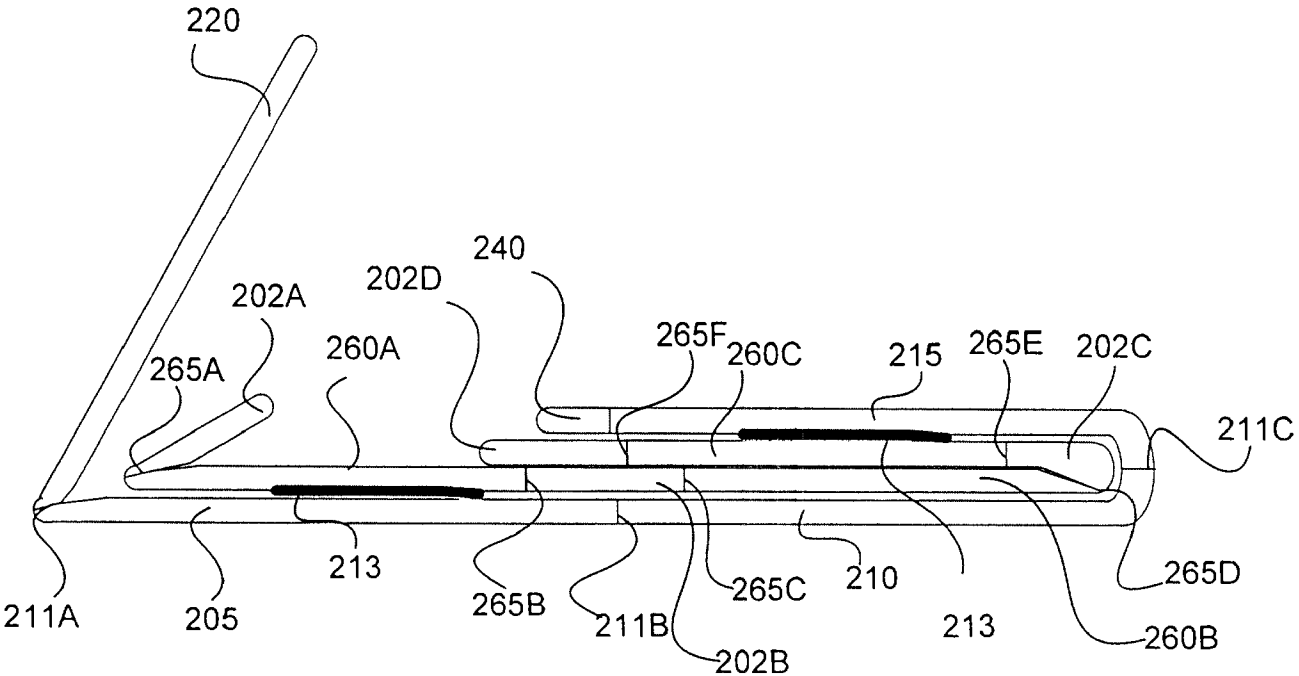

FIG. 14 illustrates the pre-assembly materials for the container of the type illustrated in FIG. 8 in a fourth stage of pre-assembly.

Figure 15:
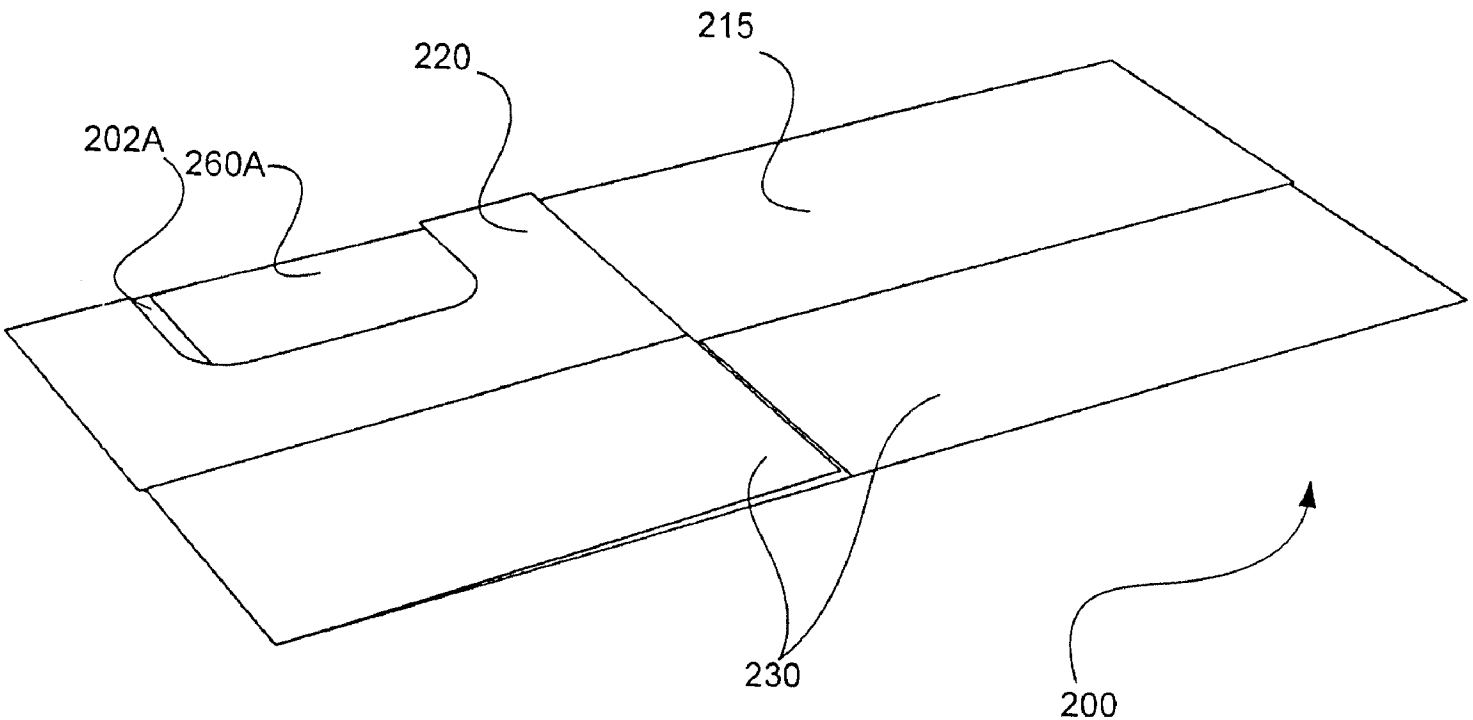

FIG. 15 illustrates the completed pre-assembly for the container of the type illustrated in FIG. 8.

Figure 16:
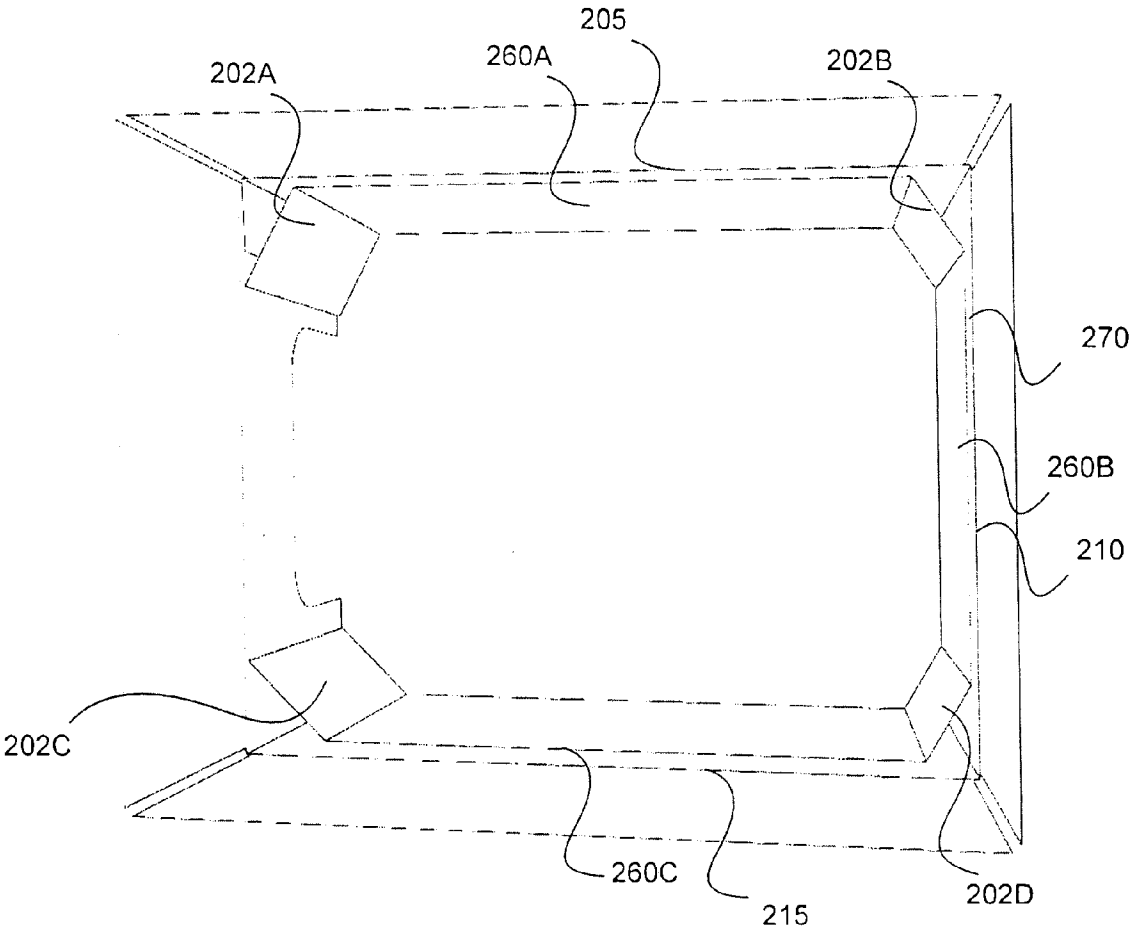

FIG. 16 illustrates a view of the container of the type illustrated in FIG. 8 during final assembly.

Figure 17:
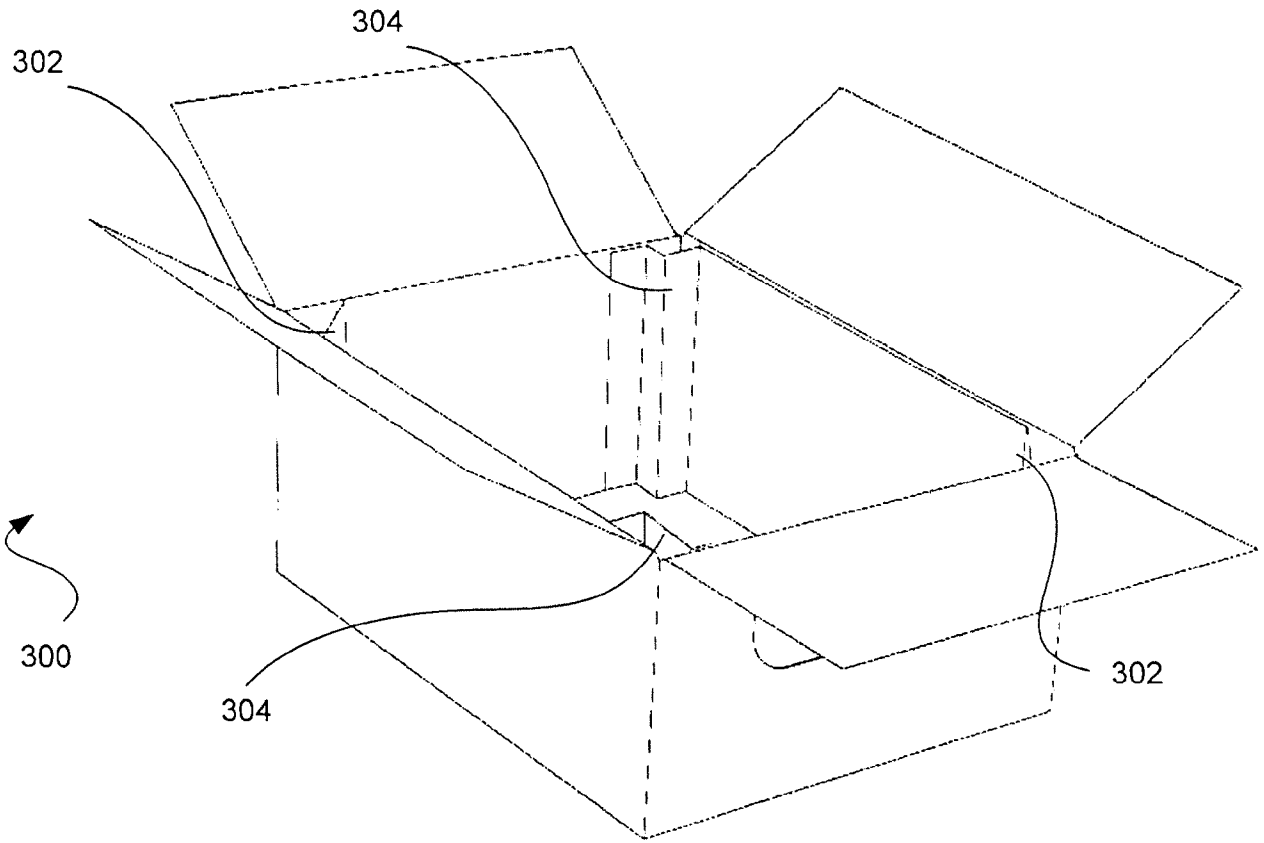

FIG. 17 illustrates a side perspective view of another container manufactured in accordance with an illustrated embodiment.

Figure 18:
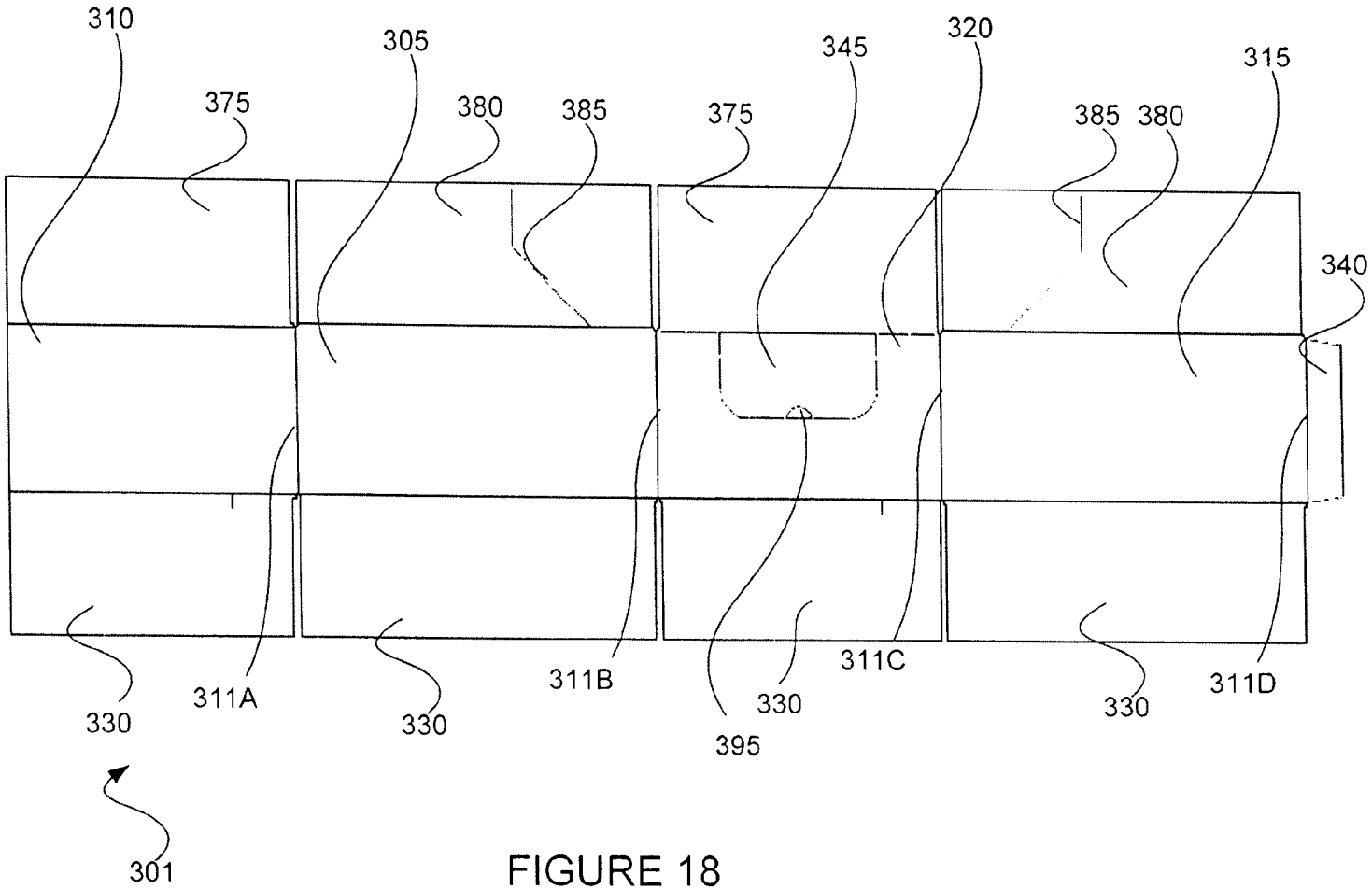

FIG. 18 illustrates an example of a primary blank used in manufacturing the container of the type illustrated in FIG. 17.

Figure 19:
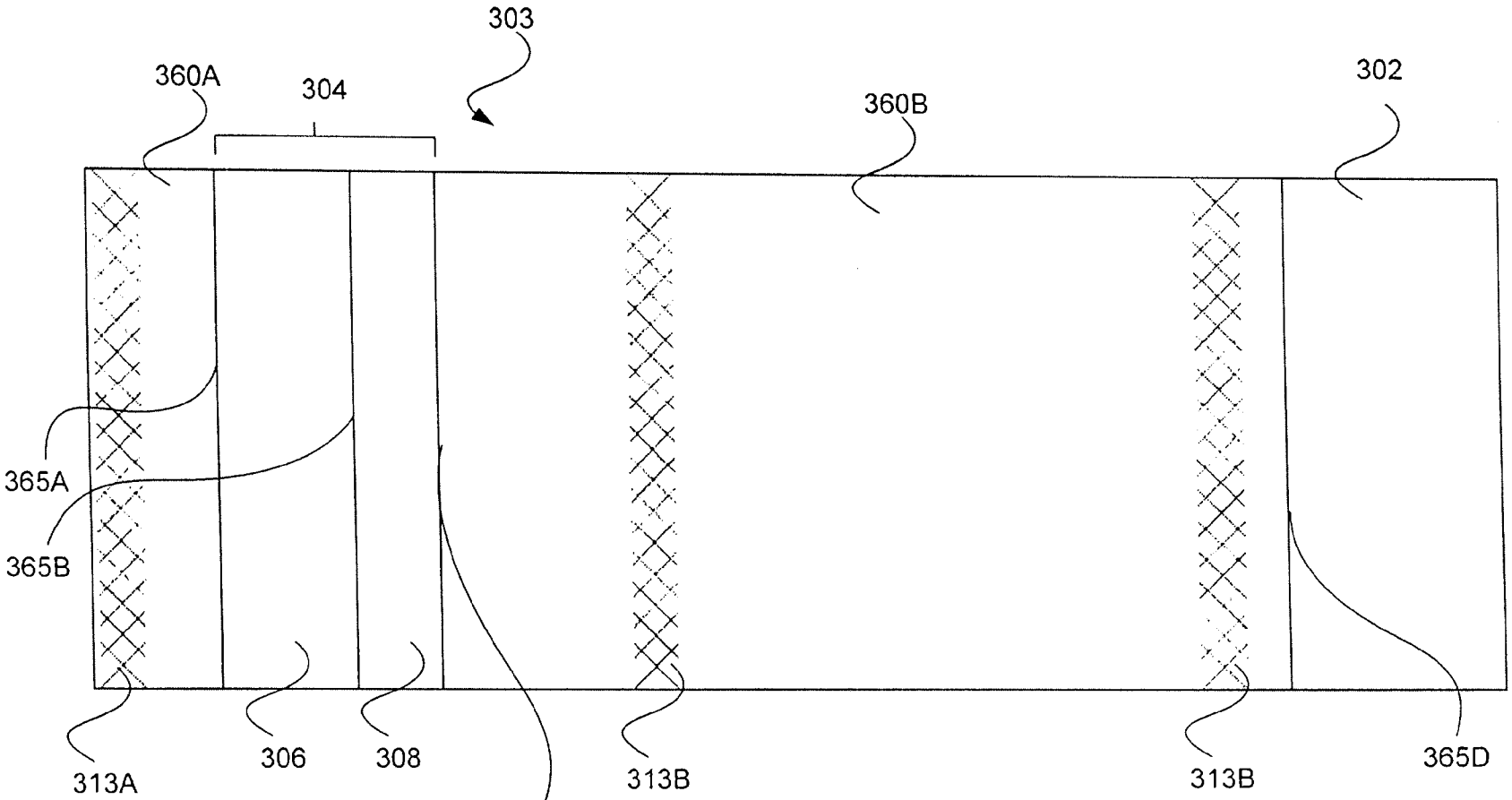

FIG. 19 illustrates another example of a supplementary blank used in manufacturing the container of the type illustrated in FIG. 17.

Figure 20:
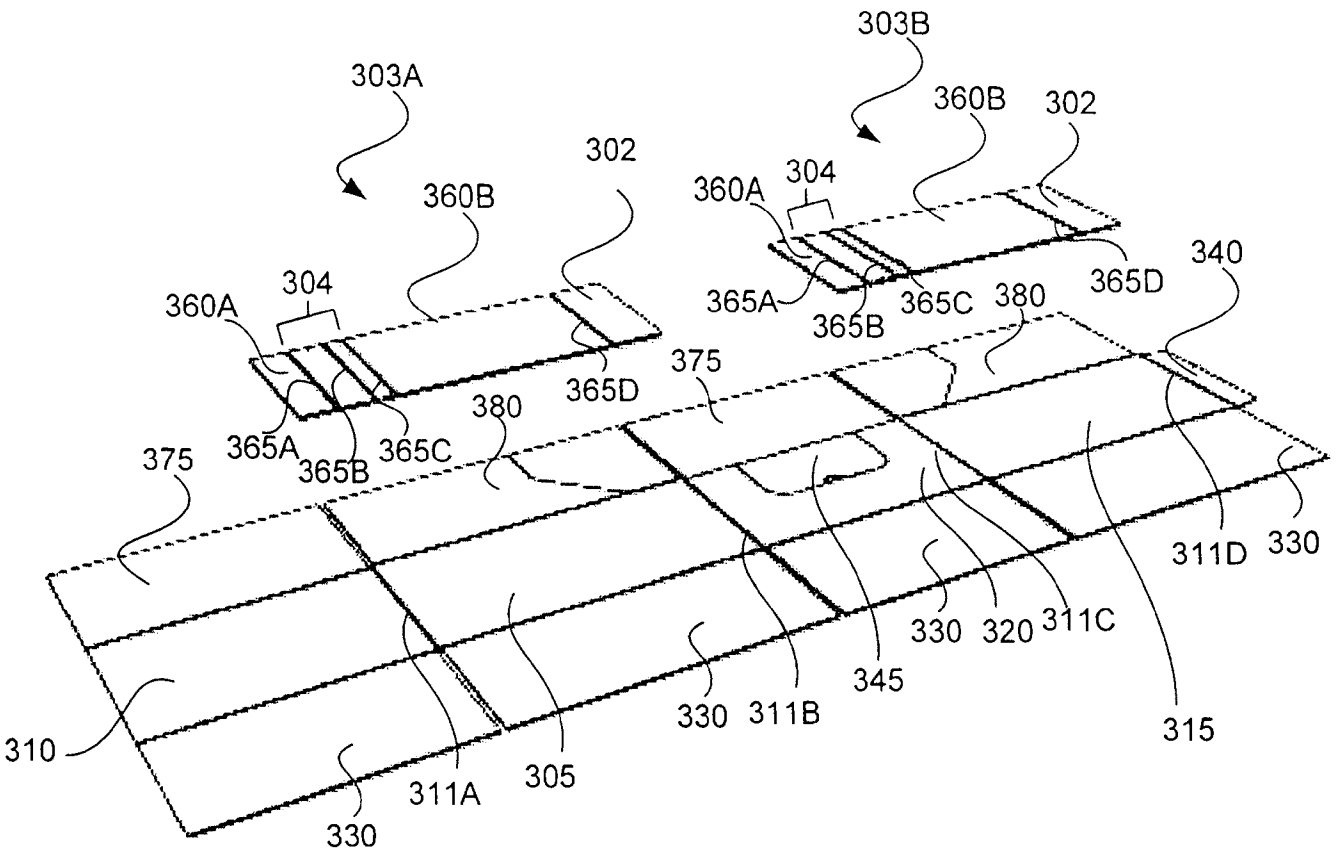

FIG. 20 illustrates the pre-assembly materials for the container of the type illustrated in FIG. 17 in a first stage of pre-assembly.

Figure 21:
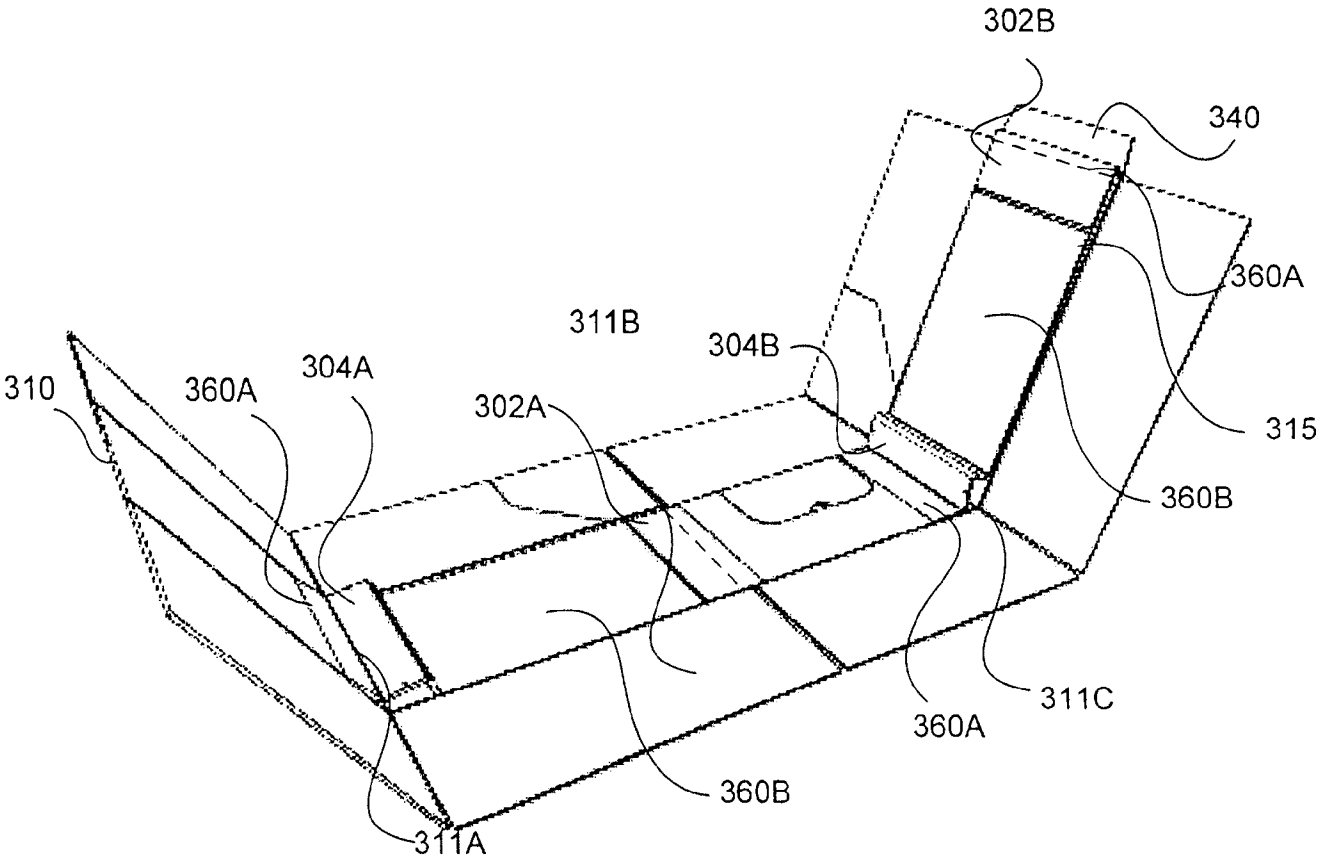

FIG. 21 illustrates the pre-assembly materials for the container of the type illustrated in FIG. 17 in a second stage of pre-assembly.

Figure 22:
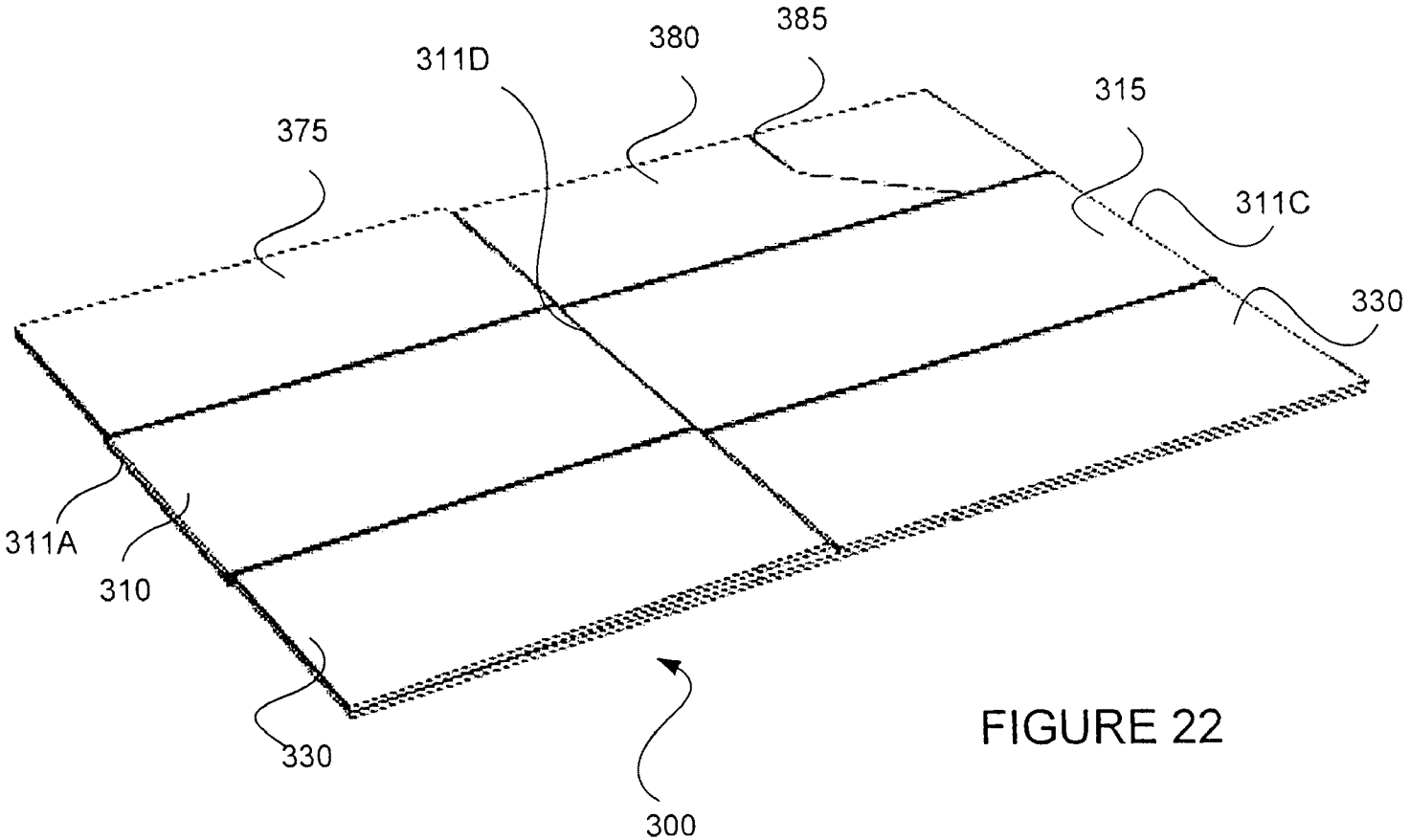

FIG. 22 illustrates the completed pre-assembly for the container of the type illustrated in FIG. 17.

Figure 23:
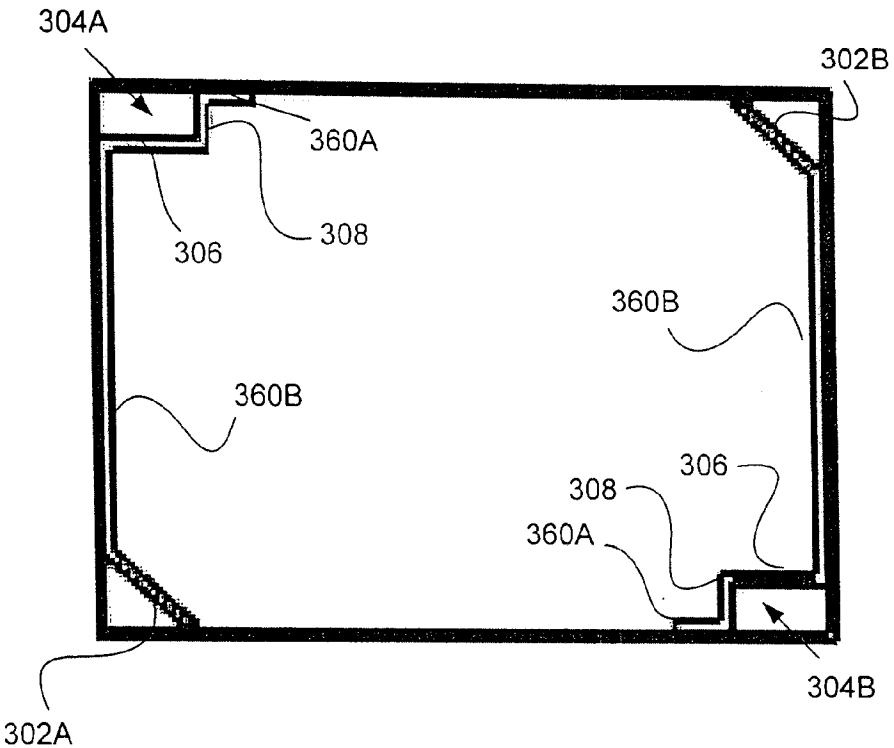

FIG. 23 illustrates a top view of the finally assembled container of the type illustrated in FIG. 17.

Figure 24:
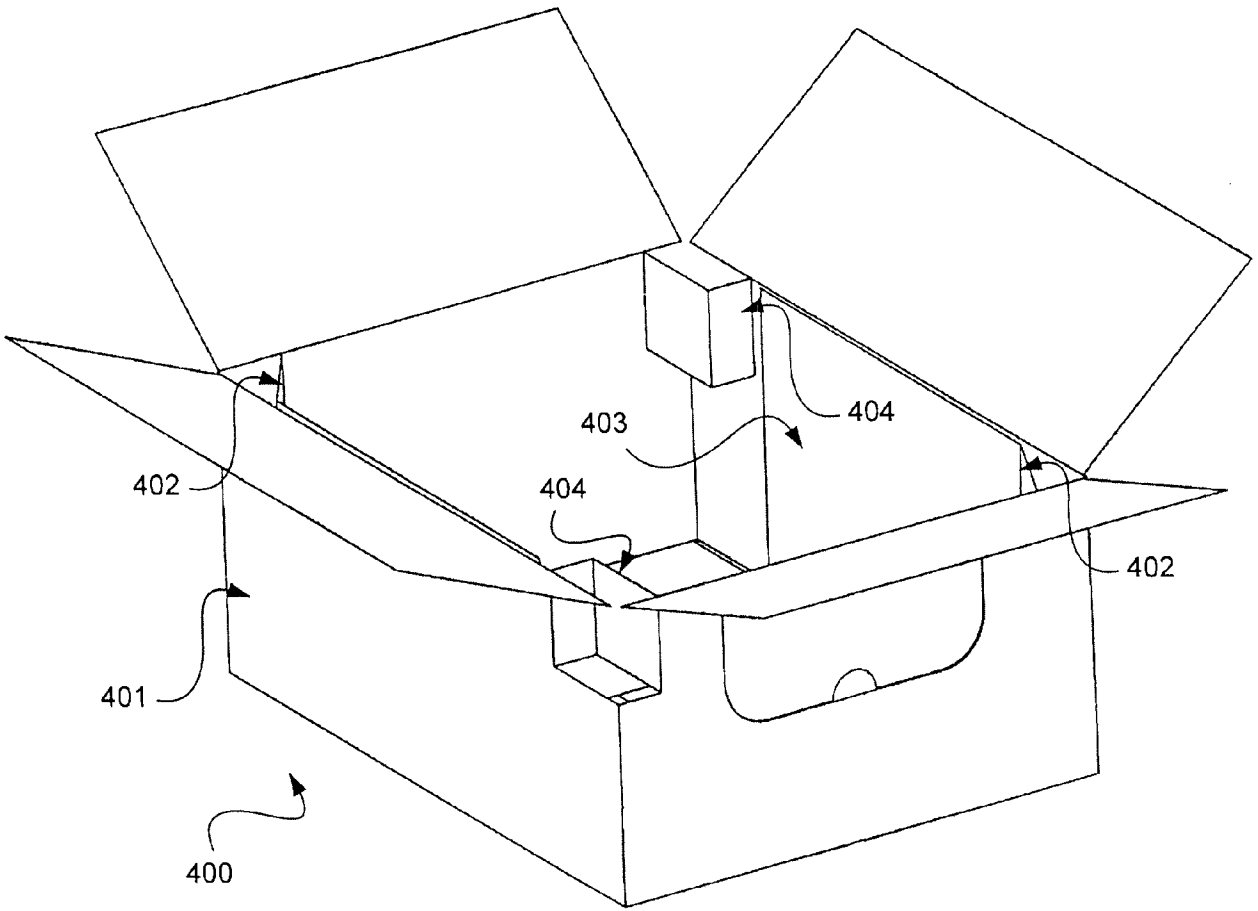

FIG. 24 illustrates a side perspective view of another container manufactured in accordance with an illustrated embodiment.

Figure 25:
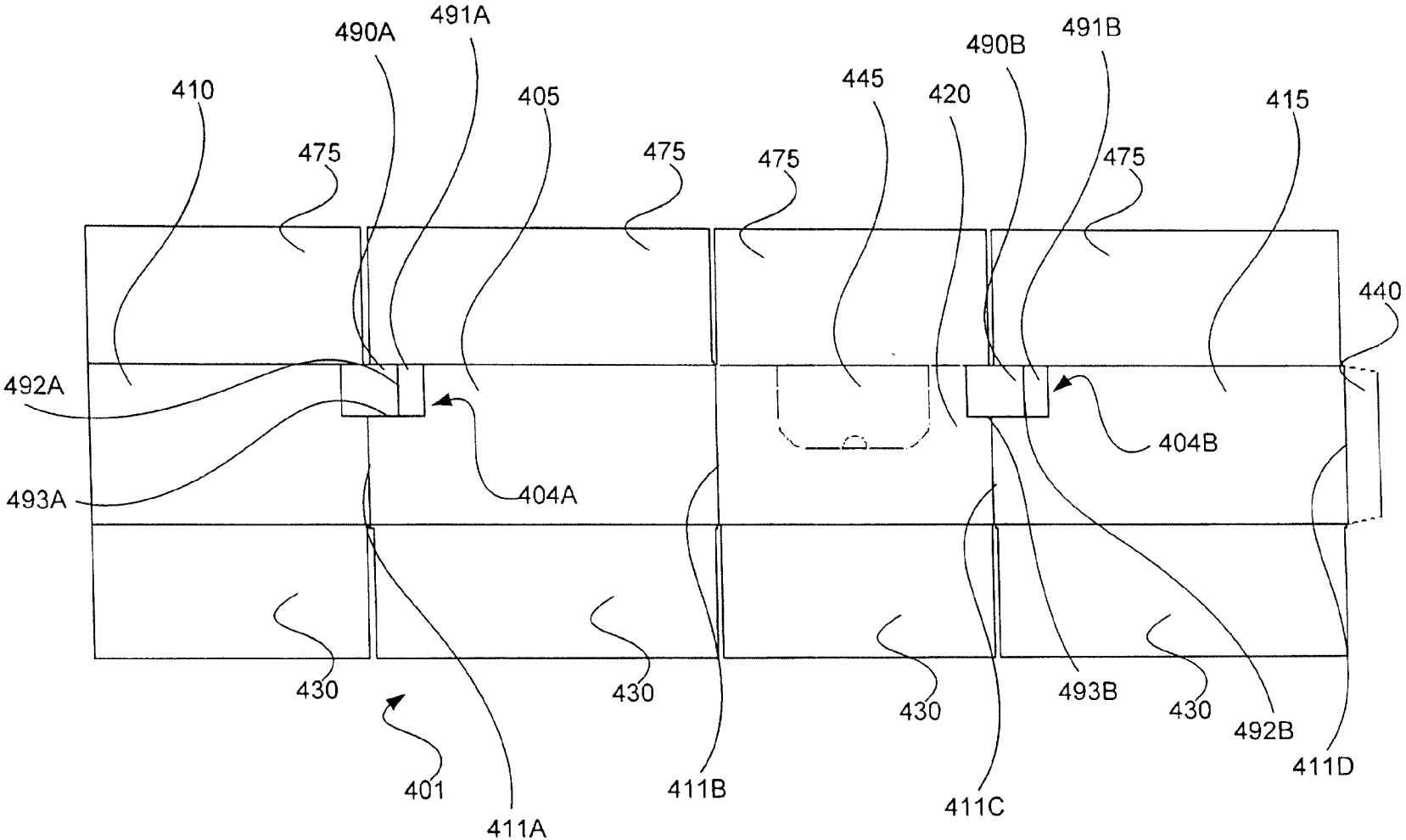

FIG. 25 illustrates an example of a primary blank used in manufacturing the container of the type illustrated in FIG. 24.

Figure 26:
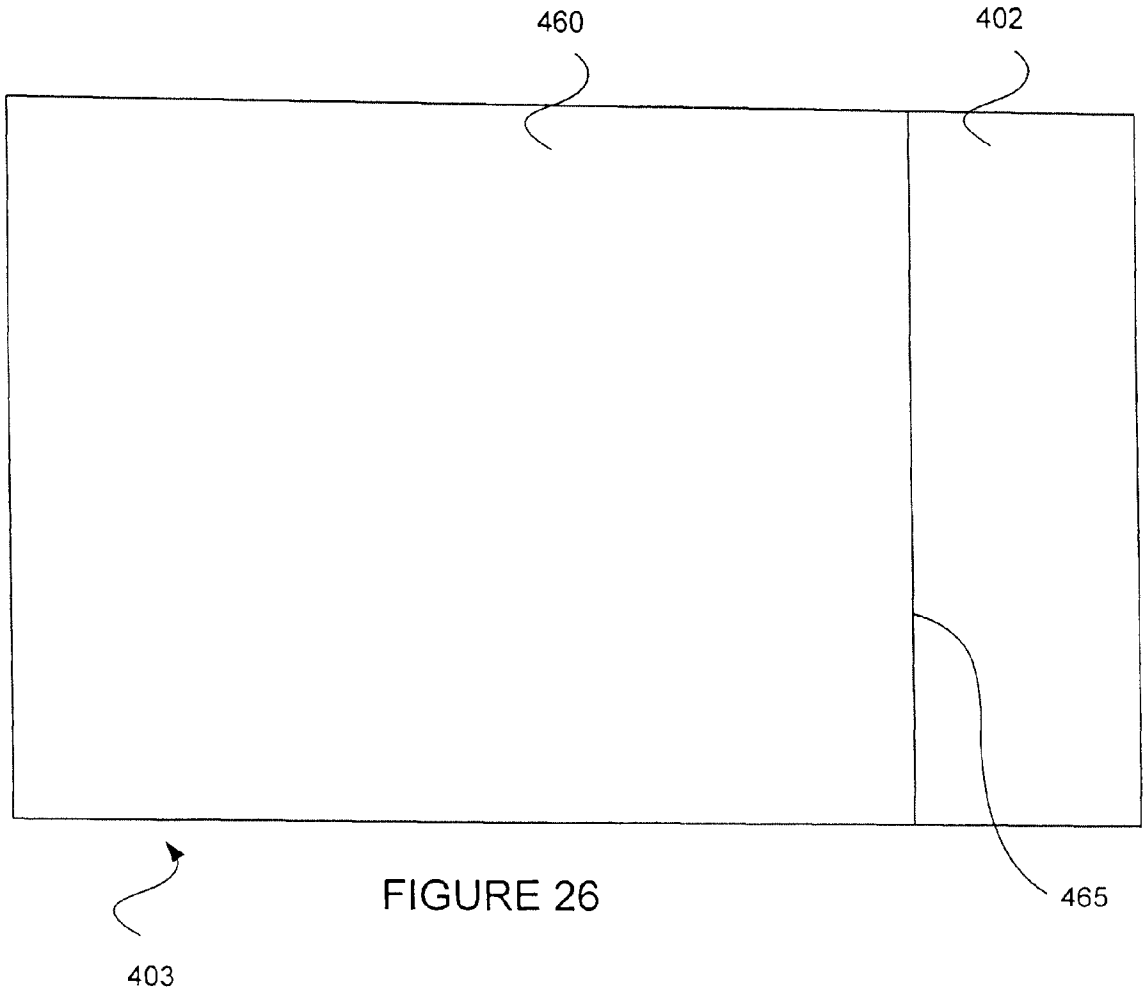

FIG. 26 illustrates another example of a supplementary blank used in manufacturing the container of the type illustrated in FIG. 24.

Figure 27:
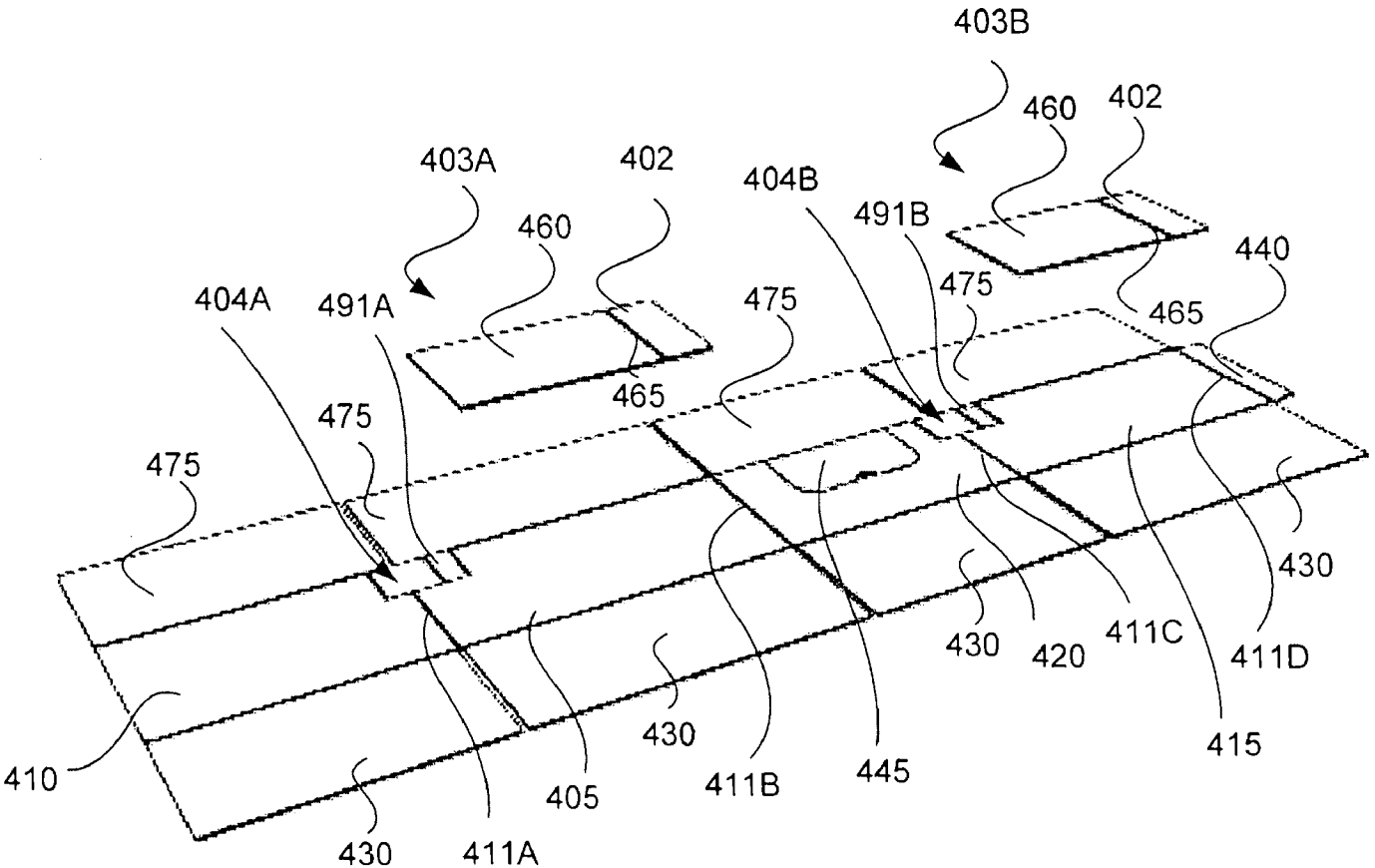

FIG. 27 illustrates the pre-assembly materials for the container of the type illustrated in FIG. 24 in a first stage of pre-assembly.

Figure 28:
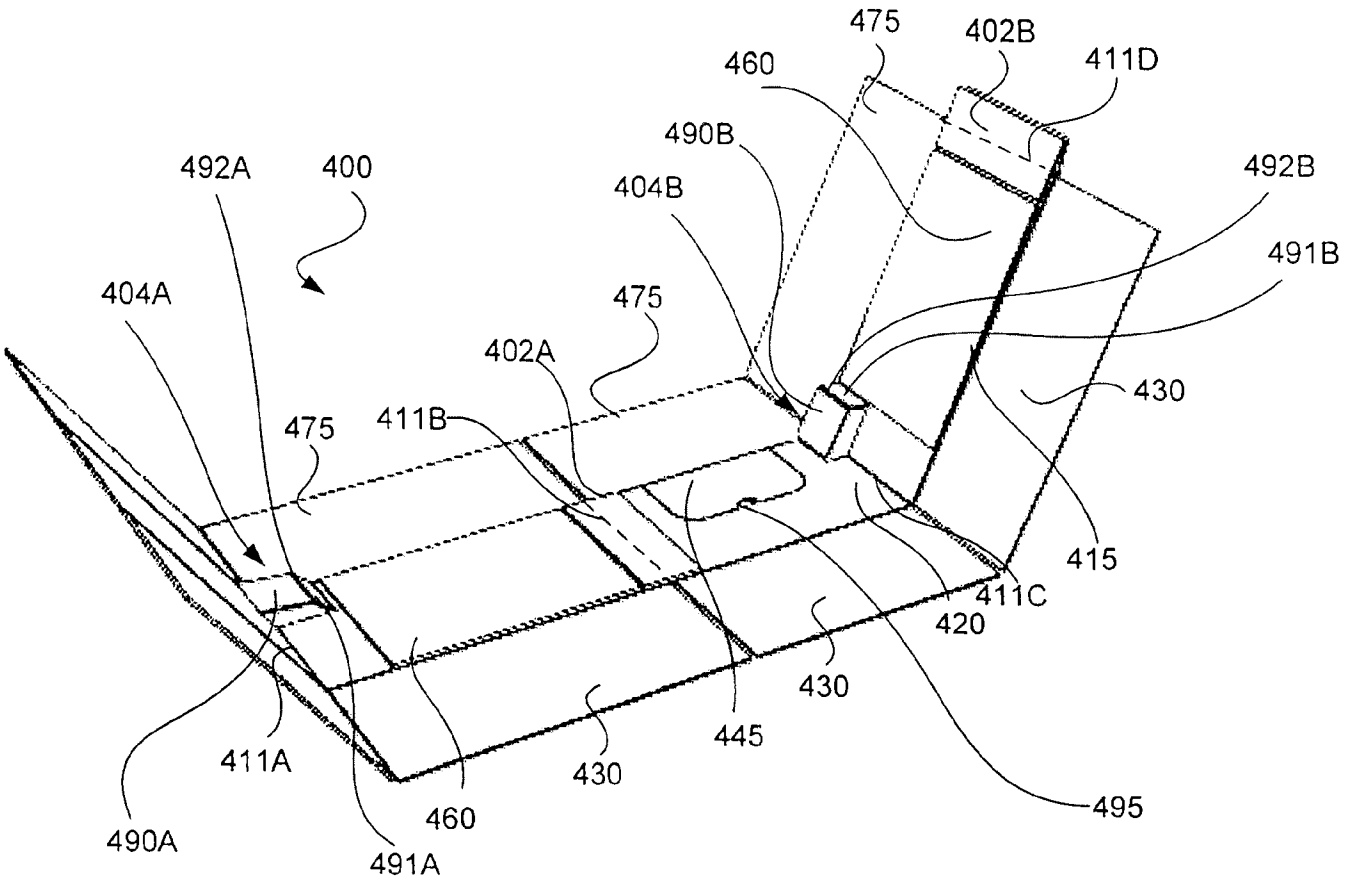

FIG. 28 illustrates the pre-assembly materials for the container of the type illustrated in FIG. 24 in a second stage of pre-assembly.

Figure 29:
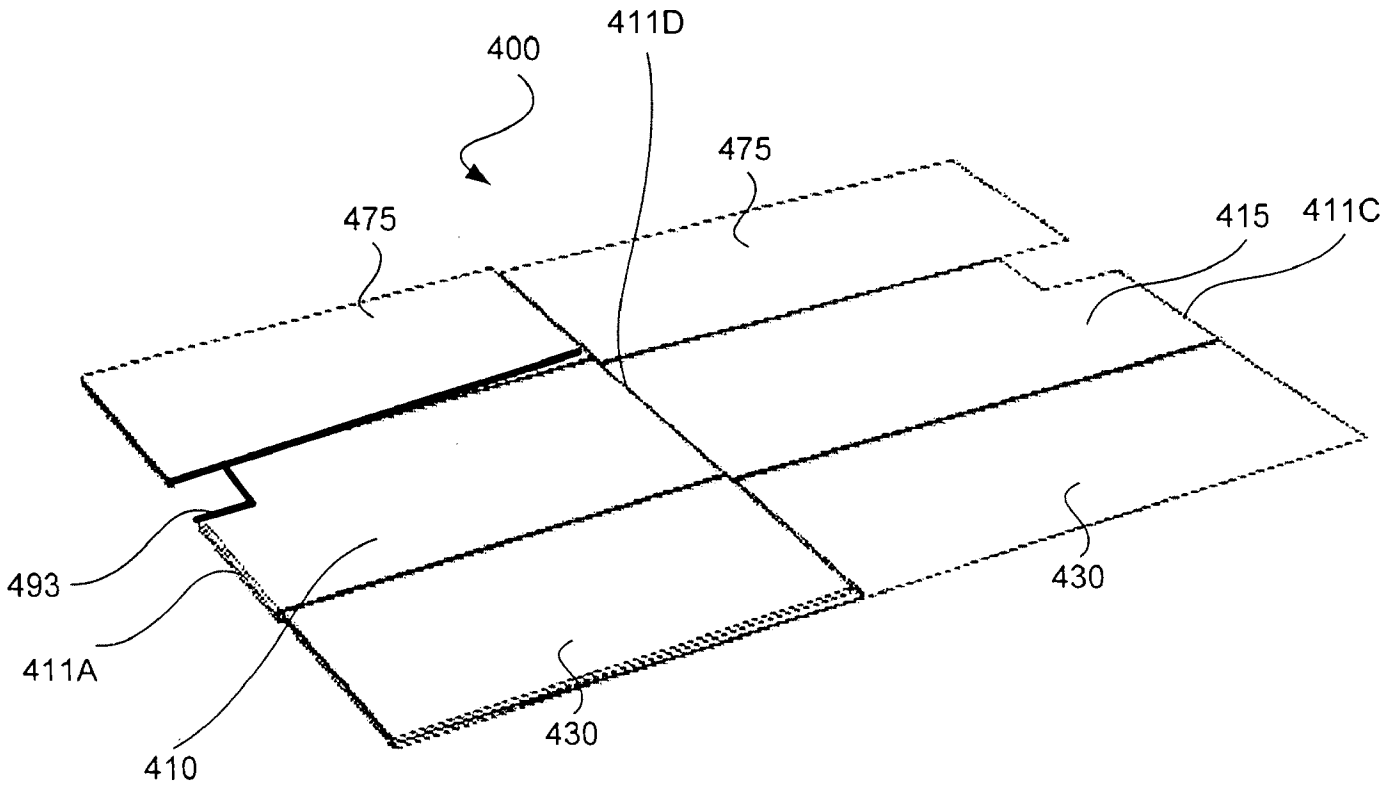

FIG. 29 illustrates the completed pre-assembly for the container of the type illustrated in FIG. 24.

Figure 30:
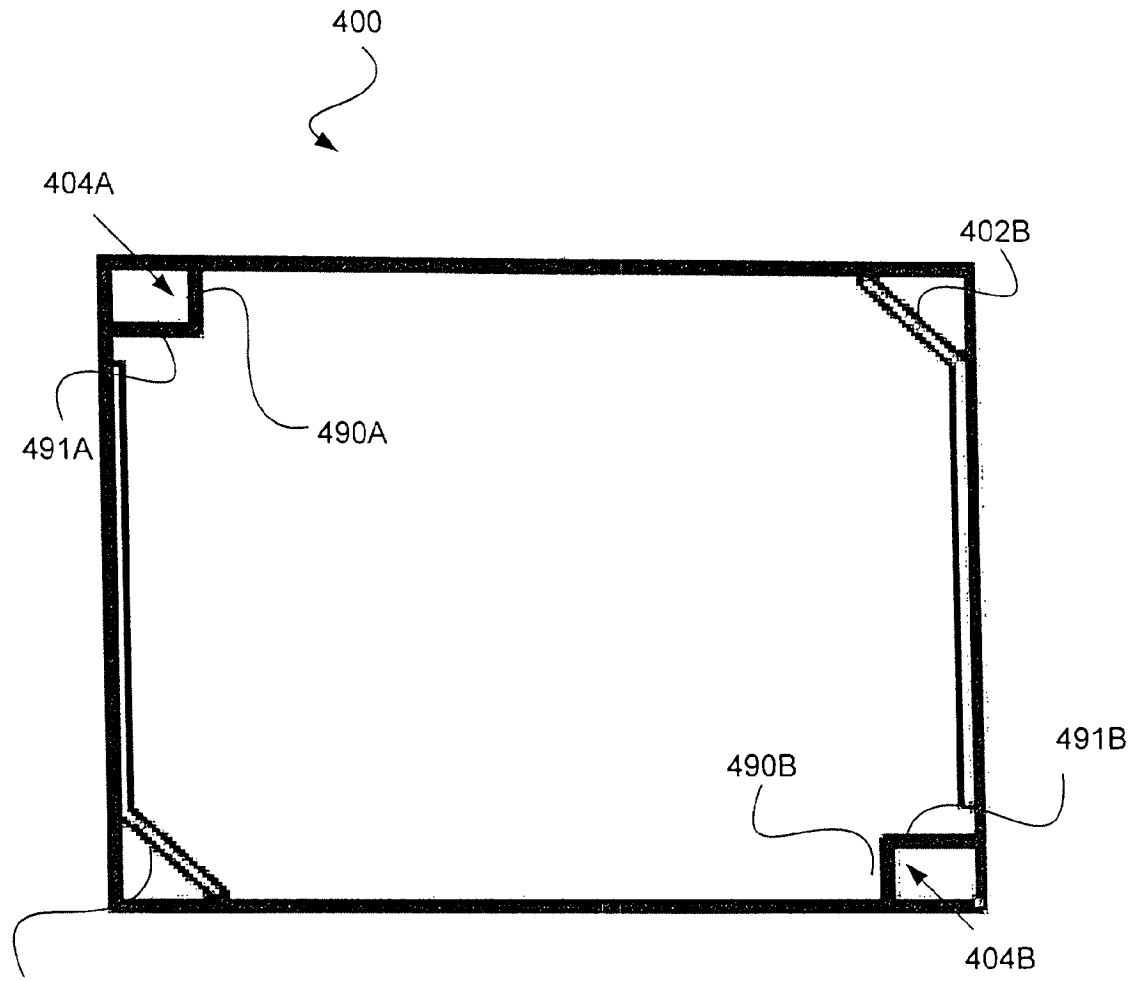

FIG. 30 illustrates a top view of the finally assembled container of the type illustrated in FIG. 24.

Figure 31:
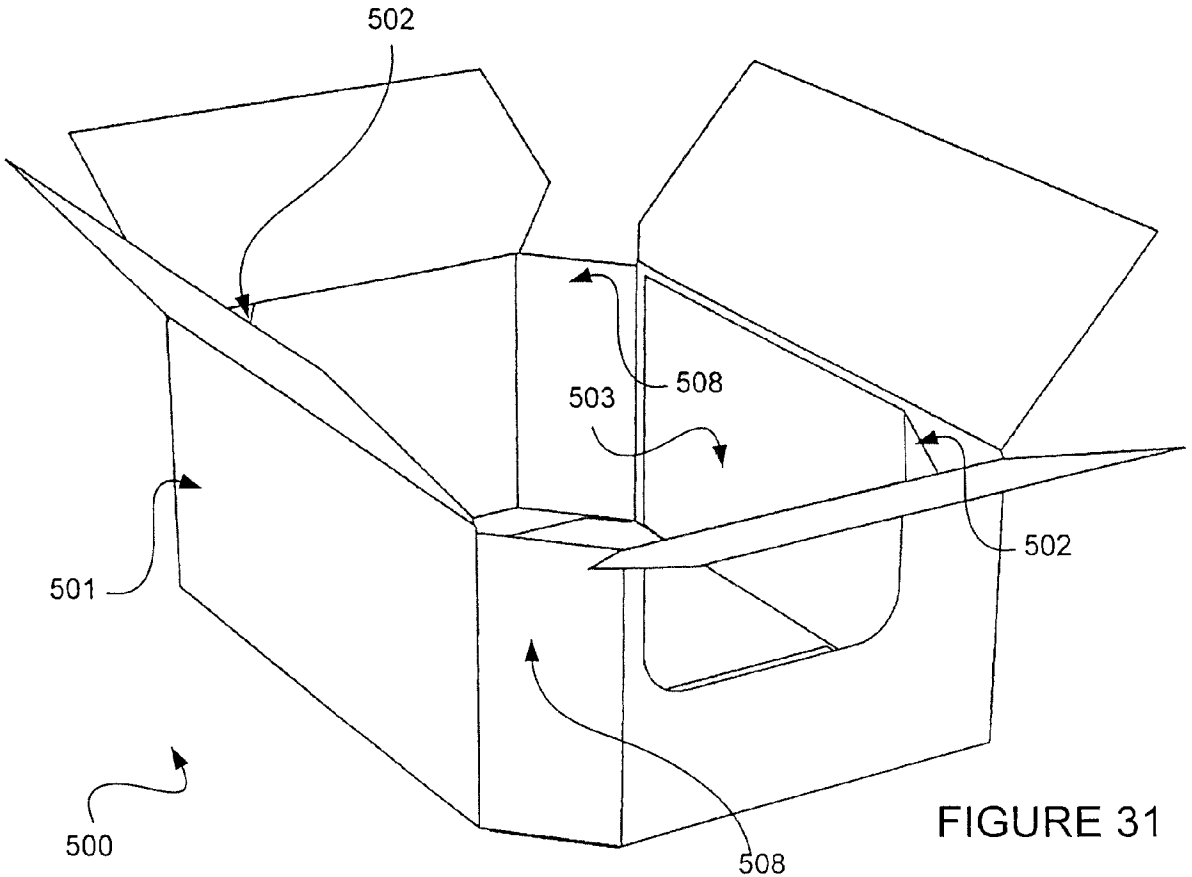

FIG. 31 illustrates a side perspective view of another container manufactured in accordance with an illustrated embodiment.

Figure 32:
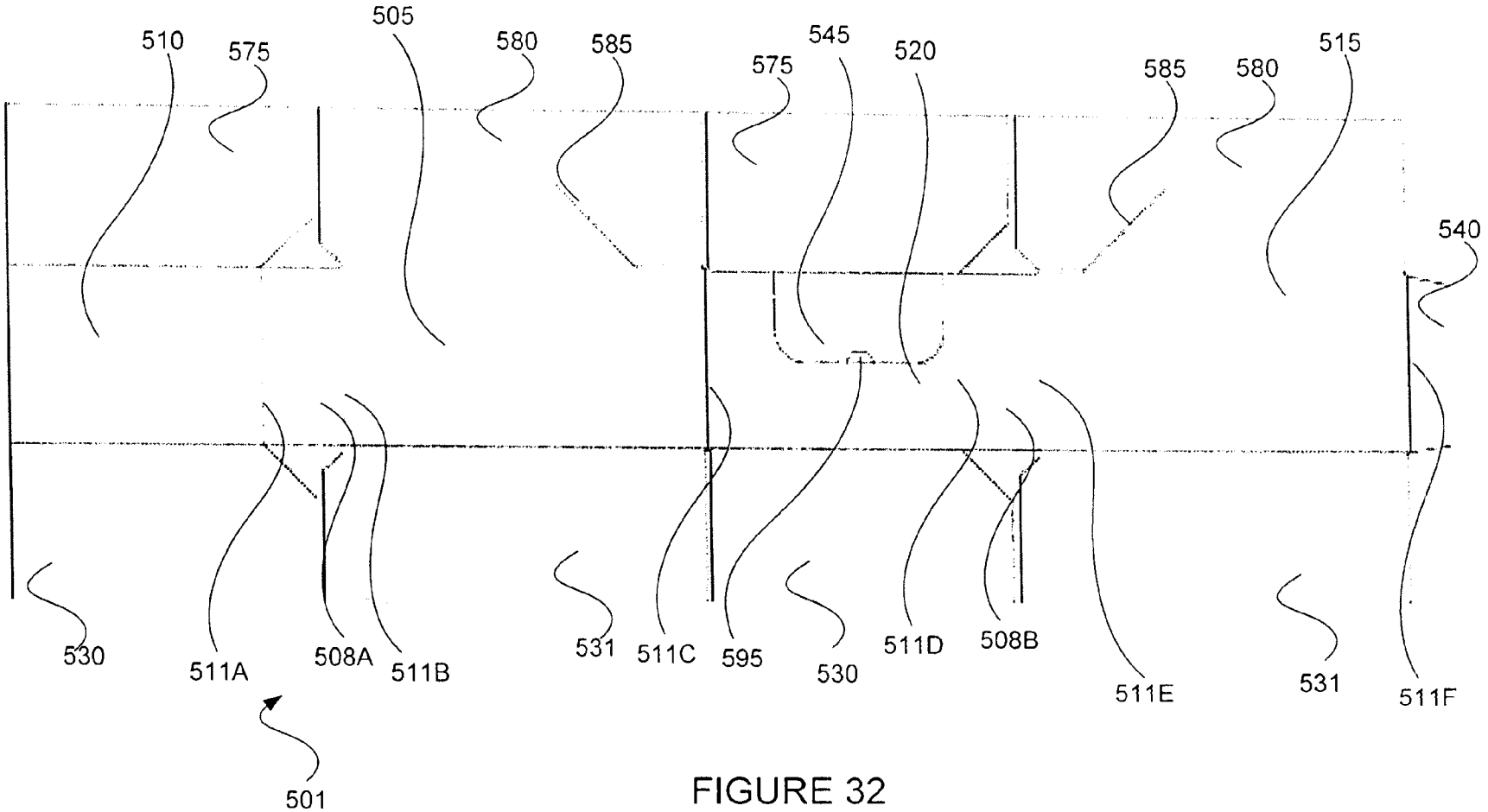

FIG. 32 illustrates an example of a primary blank used in manufacturing the container of the type illustrated in FIG. 31.

Figure 33:
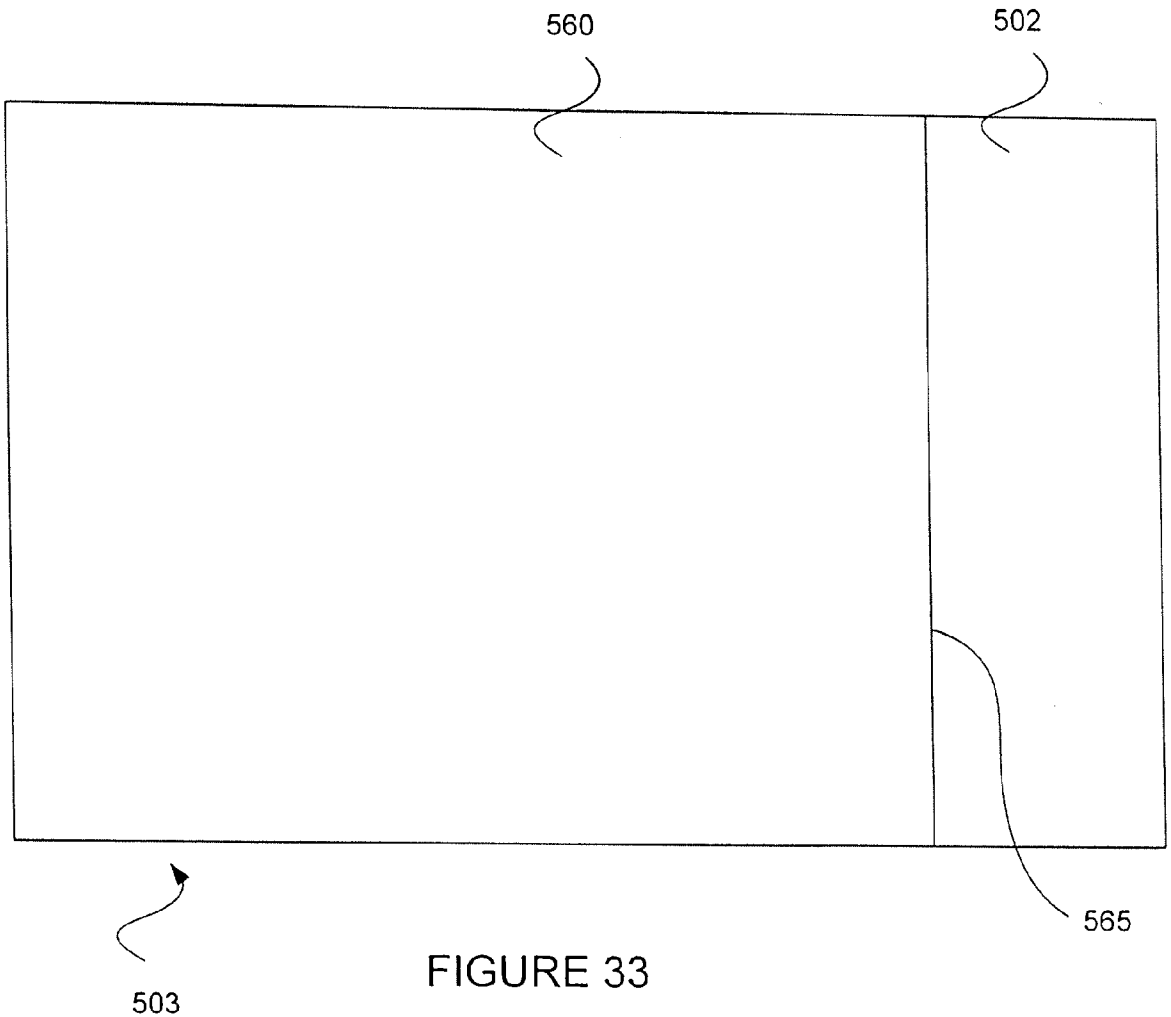

FIG. 33 illustrates another example of a supplementary blank used in manufacturing the container of the type illustrated in FIG. 31.

Figure 34:
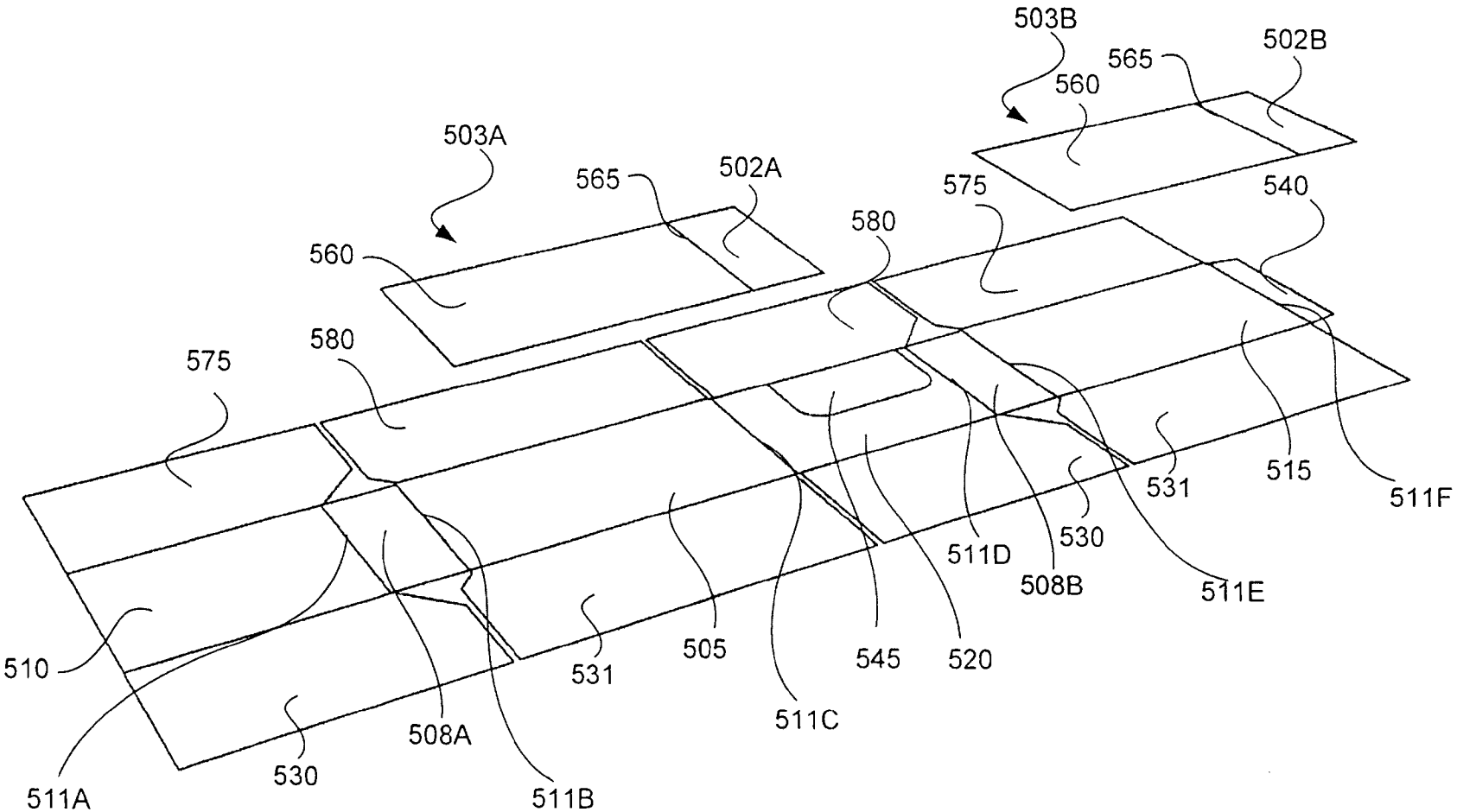

FIG. 34 illustrates the pre-assembly materials for a container of the type illustrated in FIG. 31 in a first stage of pre-assembly.

Figure 35:
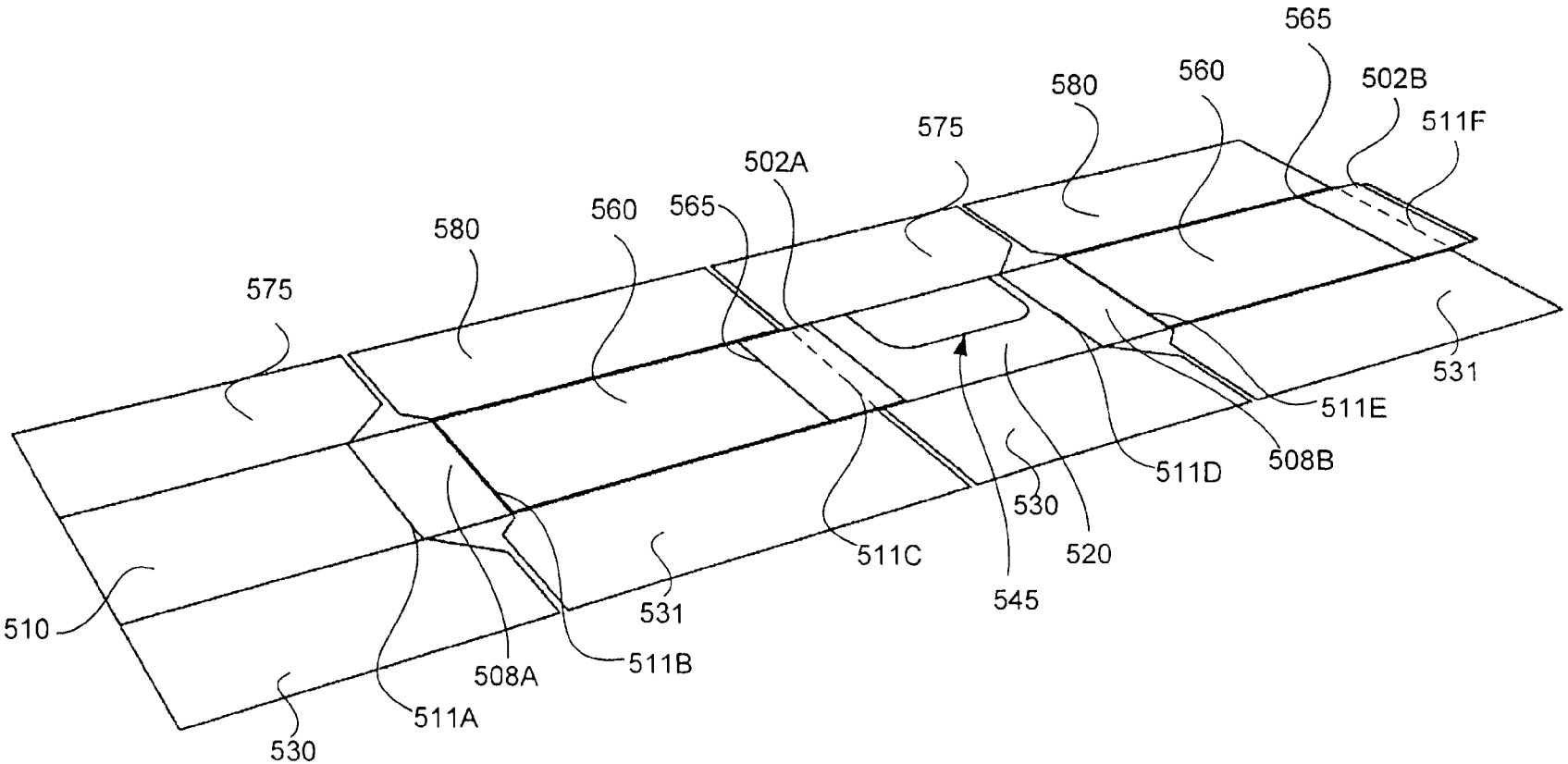

FIG. 35 illustrates the pre-assembly materials for a container of the type illustrated in FIG. 31 in a second stage of pre-assembly.

Figure 36:
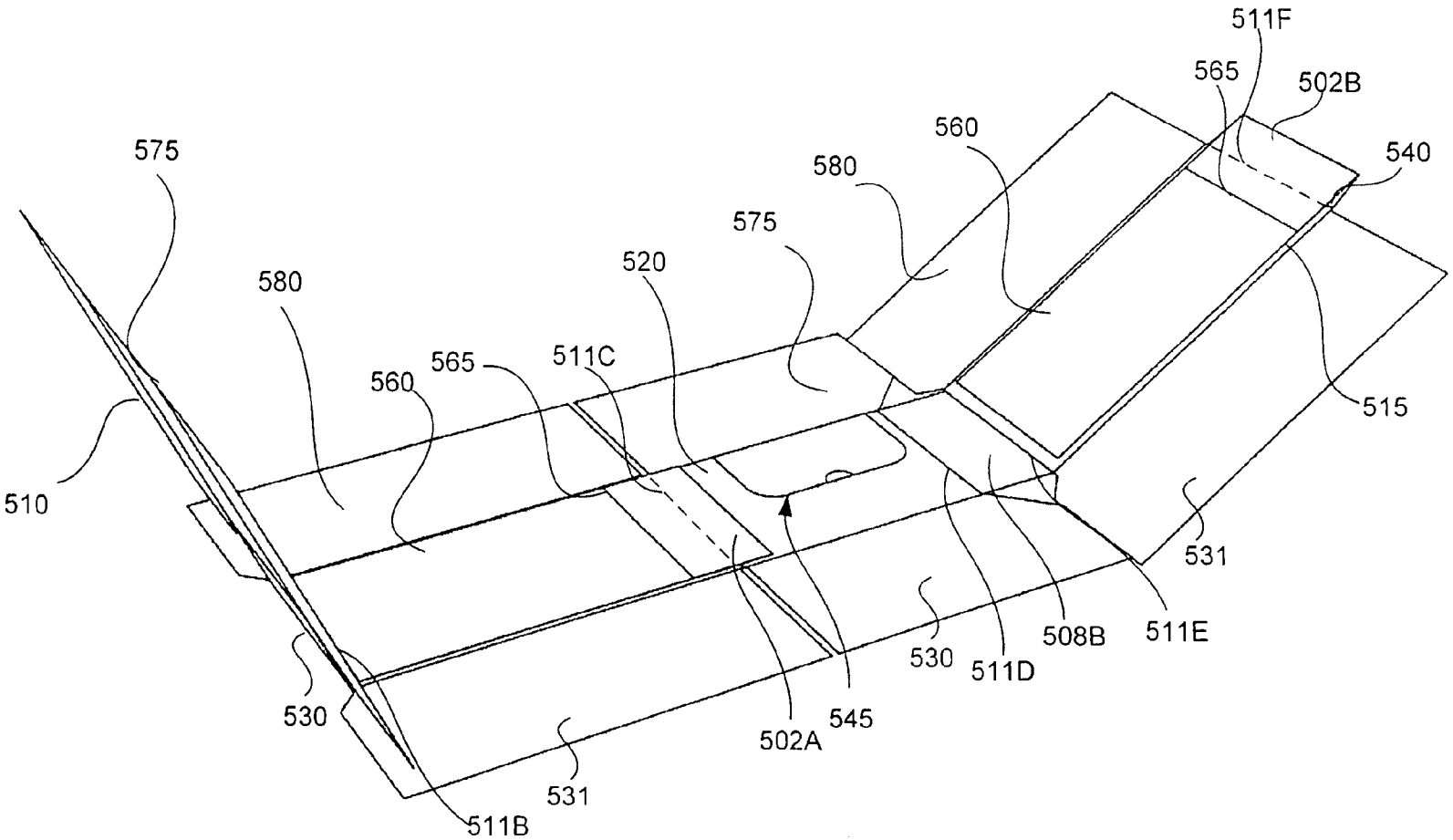

FIG. 36 illustrates the pre-assembly materials for a container of the type illustrated in FIG. 31 in a third stage of pre-assembly.

Figure 37:
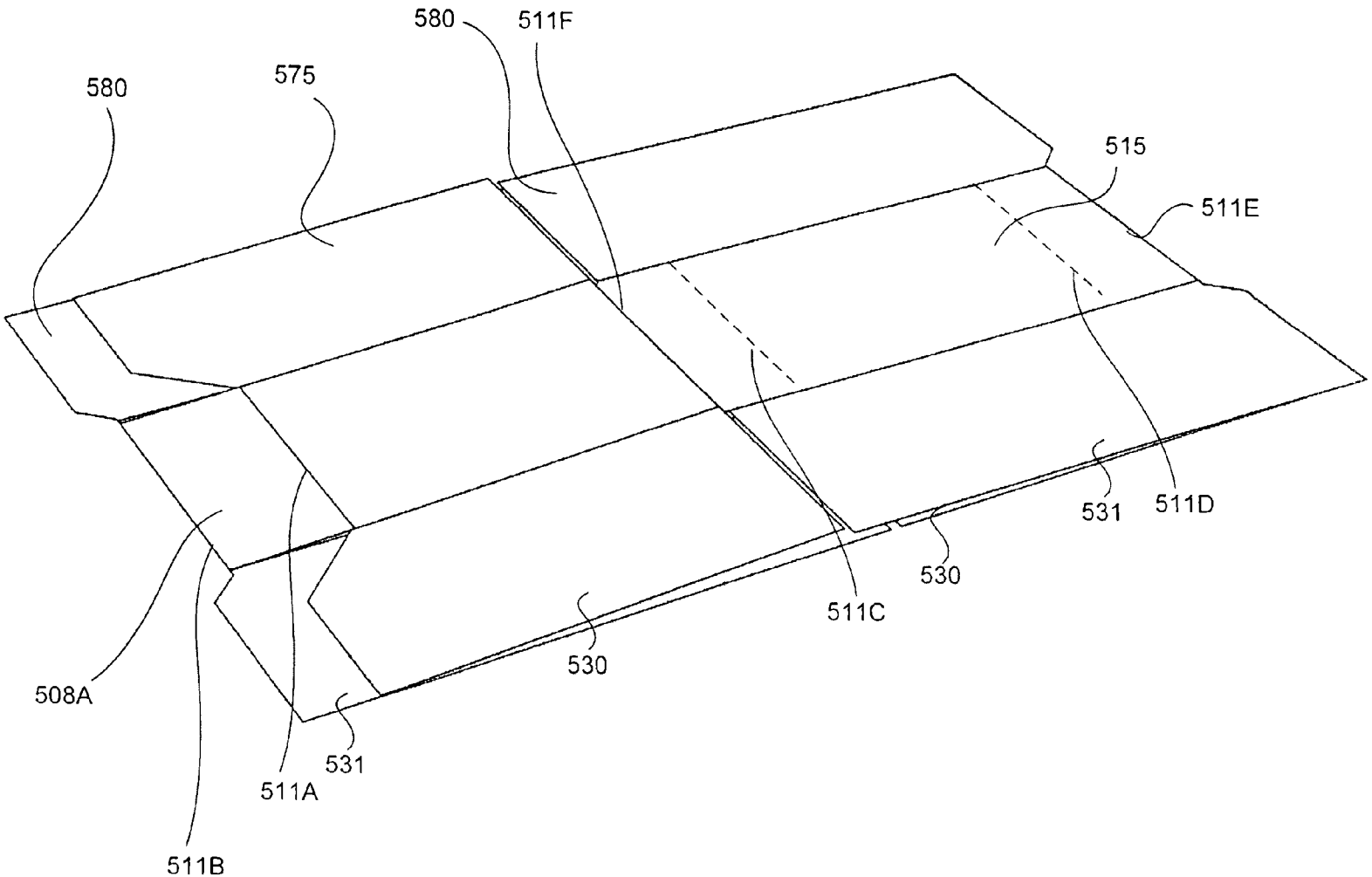

FIG. 37 illustrates the completed pre-assembly for the container of the type illustrated in FIG. 31.

Figure 38:
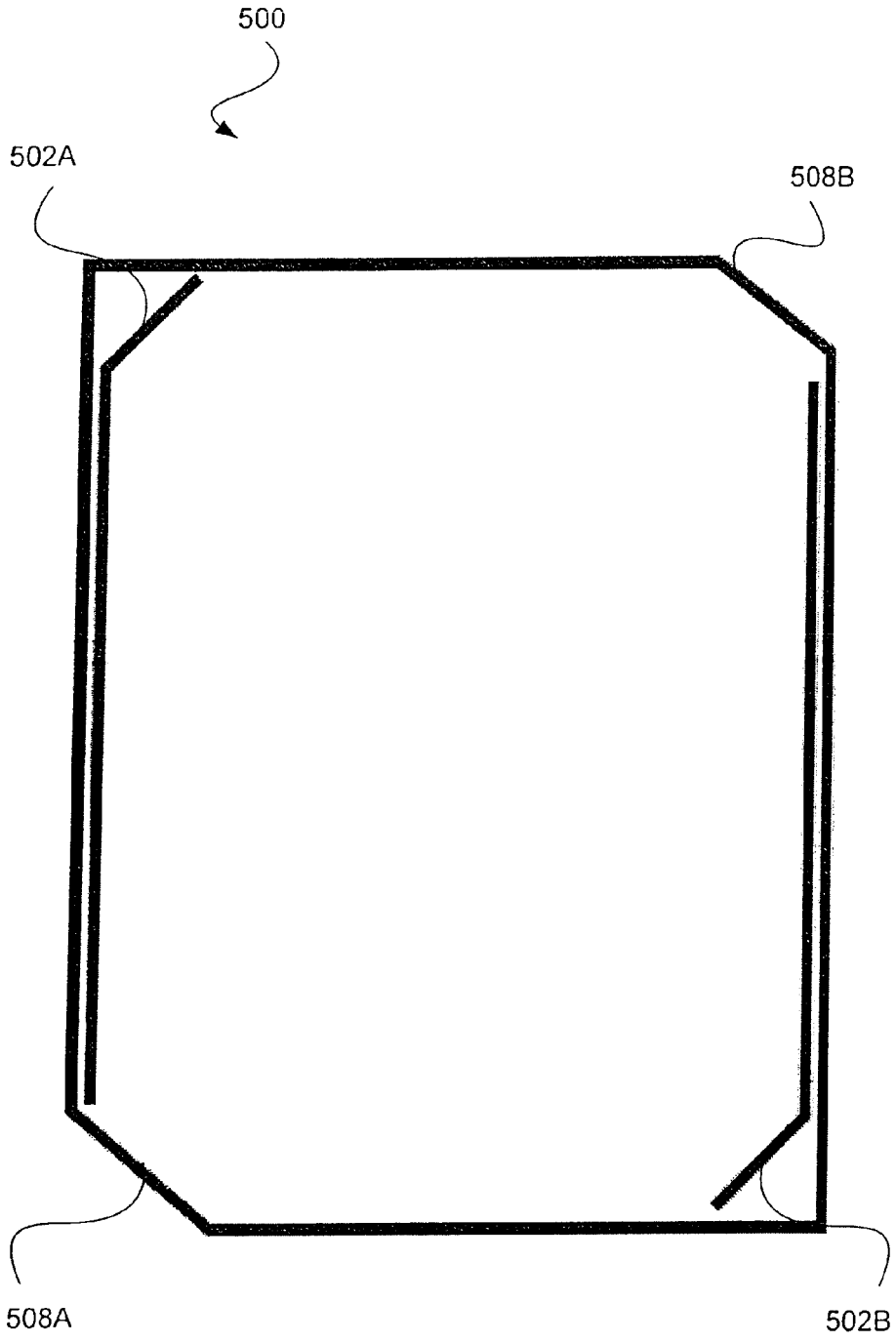

FIG. 38 illustrates a top view of the finally assembled container of the type illustrated in FIG. 31.

DETAILED DESCRIPTION OF THE INVENTION

In the following description of various invention embodiments, reference is made to the accompanying drawings, which form a part hereof, and in which is shown, by way of illustration, various embodiments in which the invention may be practiced. It is to be understood that other embodiments may be utilized and structural and functional modifications may be made without departing from the scope and spirit of the present invention.

The manufacture and use of containers that may be used for more than one purpose, e.g., for transport of product and subsequent display of product in a retail environment, are becoming increasingly popular among both manufacturers and retailers because such containers enable a reduction or minimization of the amount of container material while increasing or maximizing the amount of display space available for product. Thus, it is conventionally known that blanks (e.g., made from some type of paperboard and/or other material that is die-cut and scored for subsequent manipulation to form a pre-assembly), pre-assemblies (e.g., a partially assembled container wherein the blank(s) is manipulated and affixed to itself but is not finally assembled) and containers (e.g., packaging, cartons, boxes, etc.) may be provided that enable product to be transported to a retail environment in a transporting container and displayed in the retail environment within the transporting container following minor modification of the container.

The durability, strength and stackability of such packaging often require increasing the amount of material content within the container. However, further reducing the amount of material content within containers has become a significant goal of many manufacturers and retailers because of the adverse effect that container has on landfills and the environment in general as well as the cost of manufacturing, transporting and disposing of such containers.

Thus, both manufacturers and retailers are recognizing a need to reduce the amount of containers used to provide product to an end-consumer in a retail supply chain in an effort to conserve natural resources, reduce an impact on the environment and reduce costs associated with product manufacture and sale. In an effort to achieve these goals, various initiatives have been put in place by both suppliers and retailers to reduce overall product container by some percentage, e.g., five percent.

One conventional mechanism for reducing the amount of containers necessary to provide product to potential consumers in a retail environment is by providing dual-use containers wherein a container can be used both to contain product during transporting and also to display the product once that product has arrived in a retail environment, e.g., a store or other environment offering product for sale.

Further, in an effort to further use available space in a retail environment, retailers may be interested in using the display function of such dual-use containers in a manner such that containers may be stacked on top of one another to improve or optimize vertical space utility in the retail environment. Simply put, having the ability to be able to stack display cartons enables a store operator to present more product and/or different types of product in a manner that a customer can see. For example, by providing the opportunity to stack such containers, e.g., display cartons, on a counter, a store operator is able to increase the use of counter space such that more than one carton can occupy the same horizontal counter foot print. As is understood in the retail industry, such a configuration increases sales because customers are able to see more available product and product types for sale.

However, a problem with stacking such display cartons and shipping cartons, whether such packaging is dual-use transporting/display containers or otherwise, is that the weight of the carton(s) in combination with the weight of the product(s) stored in the container(s) can cause one or more containers to be damaged or collapse. As a result, a store operator is left with damaged, ineffective or completely non-functioning display container(s), which causes operational problems and reduces likelihood of sales to consumers.

Accordingly, based on all of these factors, there is a need to provide a method of manufacturing reduced material content containers and resulting containers and associated pre-assemblies and blanks, which, when utilized, result in a container that has significantly improved stacking strength over conventional containers and optionally provides the dual use both as a transporting container for transporting product to a retail environment and a display container configured to display the product in that retail environment. With this understanding of one area of packaging/container utility in mind, a description of various invention embodiments is now provided.

According to as least one illustrated embodiment, there is provided equipment configured to manufacture shipping containers, display containers and/or dual-use containers, e.g., for transporting product and subsequent display of the product (as well as corresponding container pre-assemblies and blanks) that include a reduced amount of material content while maintaining or increasing the stacking strength of such containers. In view of recent retailer initiatives to reduce the amount of material content in containers, such containers may have increased utility to manufacturers and retailers. Thus, providing containers with reduced material content would be of increased value. Additionally, because of the unique structure provided in accordance with the illustrated embodiments, side wall strength is increased as well.

Additionally, based on the illustrated examples of container designs provided with auxiliary corner supports as disclosed herein, it should be appreciated that the incorporation of the corner supports also increases stackability of the resulting containers without requiring a lengthier time period for final assembly and without a need for assemblers (either human or automated or semi-automated equipment) to have superior capabilities. This is because, as explained herein, the majority, if not all, of manipulation of the preassembly to form the auxiliary corner supports is already performed as part of the final assembly of the primary blank as the exterior of the container. As a result, the additional operations needed to provide the corner supports is reduced or eliminated relative to what would be conventionally required for installing or assembling conventional auxiliary corner supports.

Figure 1:
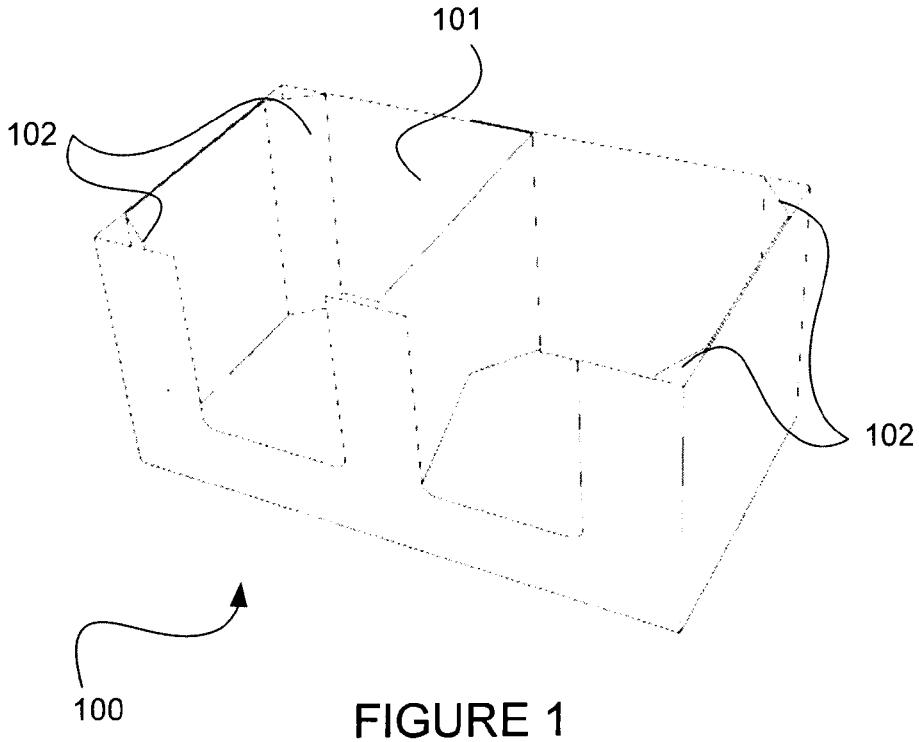

Understanding of the manufacturing of a container, blanks and/or pre-assemblies in accordance with invention embodiments may best be understood by first reviewing an illustration of a manufactured container provided in accordance with one illustrated embodiment. As illustrated in FIG. 1, one example of such a container 100 may include one or more auxiliary support sections 102 affixed at the corners of a container 100, which in this illustrated example is a dual-use container of the type referred to in the container industry as a half regular, fifth panel carton with cut-outs for display purposes (however, it should be understood that the manufactured container may be any type of carton, package, box, etc. of any suitable type). As will be appreciated from the remaining disclosure by one of ordinary skill in the art, the container 100 may be used for transport of product therein when a top and the side cut-outs are in place. Subsequent to arrival at a retail environment, for example, the top and side cut-outs may be removed to provide a display for product included therein.

Figure 2:
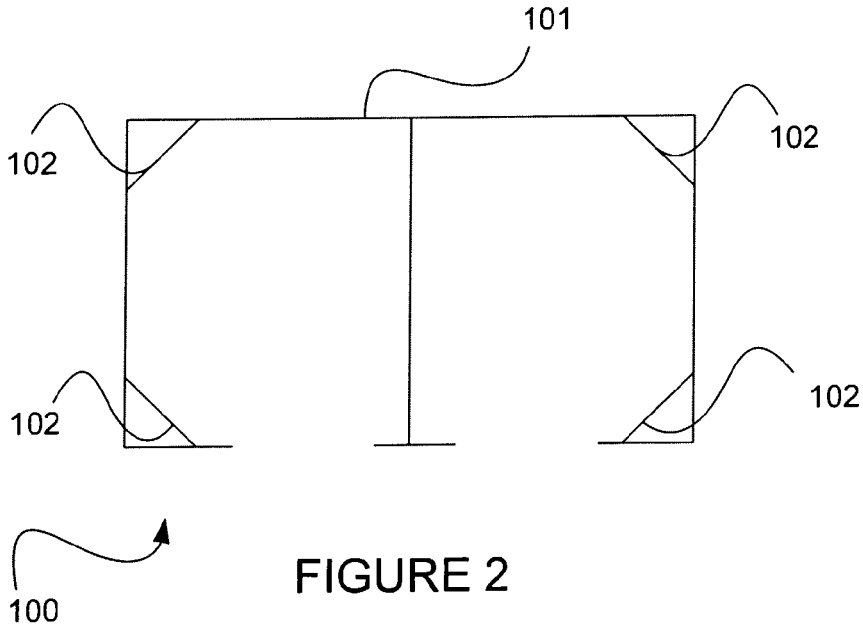

FIG. 2 provides a top view of the container 100, illustrated in FIG. 1. As shown in FIG. 2, the auxiliary support sections 102 are configured so as to be provided at corners of the container 100. As explained in connection with FIG. 5, the auxiliary support sections 102 are hingedly connected (e.g., coupled together so as to allow alteration of the angle therebetween) to a central section (160 illustrated in FIG. 5) that is affixed to lateral sides of the container 100. In an illustrated embodiment, the auxiliary support sections 102 are formed by bending back the auxiliary support sections 102 along a line that separates those sections 102 from the central section.

Figure 3:
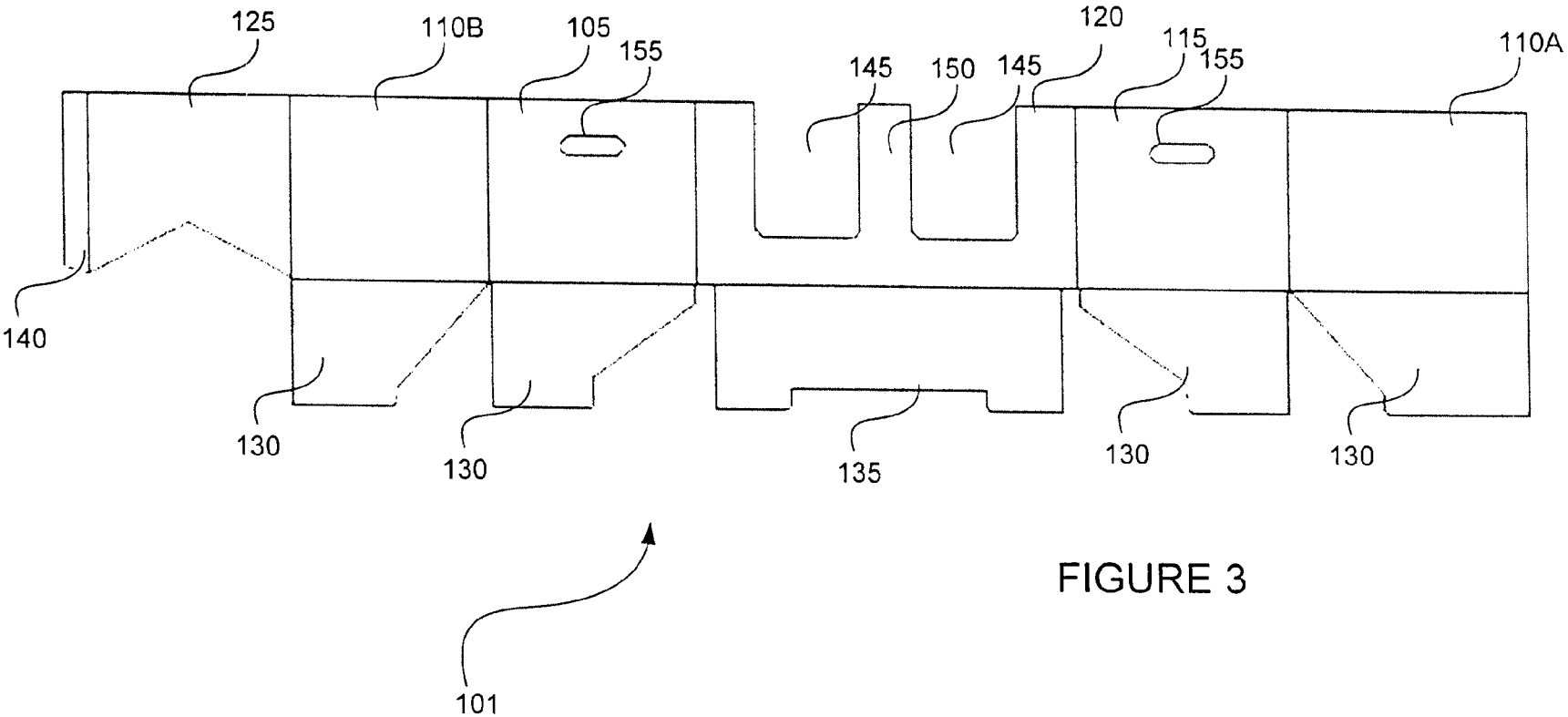

FIG. 3 illustrates an example of a primary blank for what is conventionally known as a half regular slotted bottom, fifth-panel carton such as the one illustrated in FIG. 1. The blank illustrated in FIG. 3 corresponds to the exterior of the container 100 illustrated in FIGS. 1-2. The primary blank 101 includes five panels: a first side panel 105, a first back panel 110A and second back panel 110B (which overlap to form the back panel of the container 100) a second side panel 115, a front panel 120 and a divider panel 125 that divides the container 100 into two separate compartments and provides added stackability when the container 100 is finally assembled. The blank 101 also includes five bottom sub-panels 130, 135, which cooperate and interact to form a bottom panel when the container 100 is finally assembled. Although the example of the carton illustrated in FIG. 3 is a snap-bottom or a 1-2-3-bottom container, the example is merely an illustration of one example of a packaging container that may be manufactured in accordance with the claimed invention. Therefore, it should be understood that various different types of packaging containers may be manufactured in accordance with the illustrated embodiments.

As part of manufacturing a pre-assembly for the container illustrated in FIG. 1, the first back panel 110A and the second back panel 110B are positioned so as to partially overlap and adhesive is applied to one or both sides of the overlapping areas so as to affix the overlapping areas to one another. Also, as part of that pre-assembly manufacturing, the side panels 105-120 are folded in on themselves to form a shell; adhesive applied to an adhesive panel 140 neighboring the divider panel 125 is used to couple the proximate end of the divider panel 125 to the interior side of the front panel 120, e.g., so as to horizontally bisect an area 150 between the two display access openings 145 provided in the front panel 120.

Figure 6:
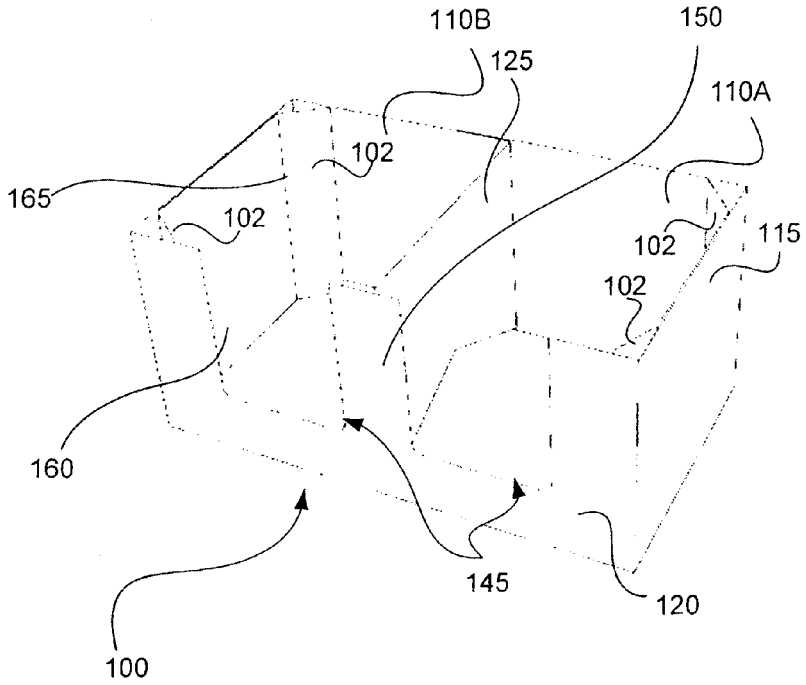

The two access openings 145 may be formed by removing additional material (not shown) to provide the access openings (as illustrated in FIG. 6), which may be defined by substantially U-shaped cut-outs in the front panel 120 of the container 100, for ready access to product displayed in the container 100. These openings 145 may be in communication with the open top end of the container 100, which (during use as a display) is free of any top panel following modification of the container 100 for the display function of the dual-use container. Thus, removable access panels or cut-outs (not shown) included in the front panel 120 (and optionally a top panel not shown) for transport of the container 100 may be readily removable therefrom once transport is completed by separating the cut-outs from the front panel 120 along pre-cut score lines to enable easy display of the product contained in the container 100 and use of the container 100 as a display of the product.

Figure 4:
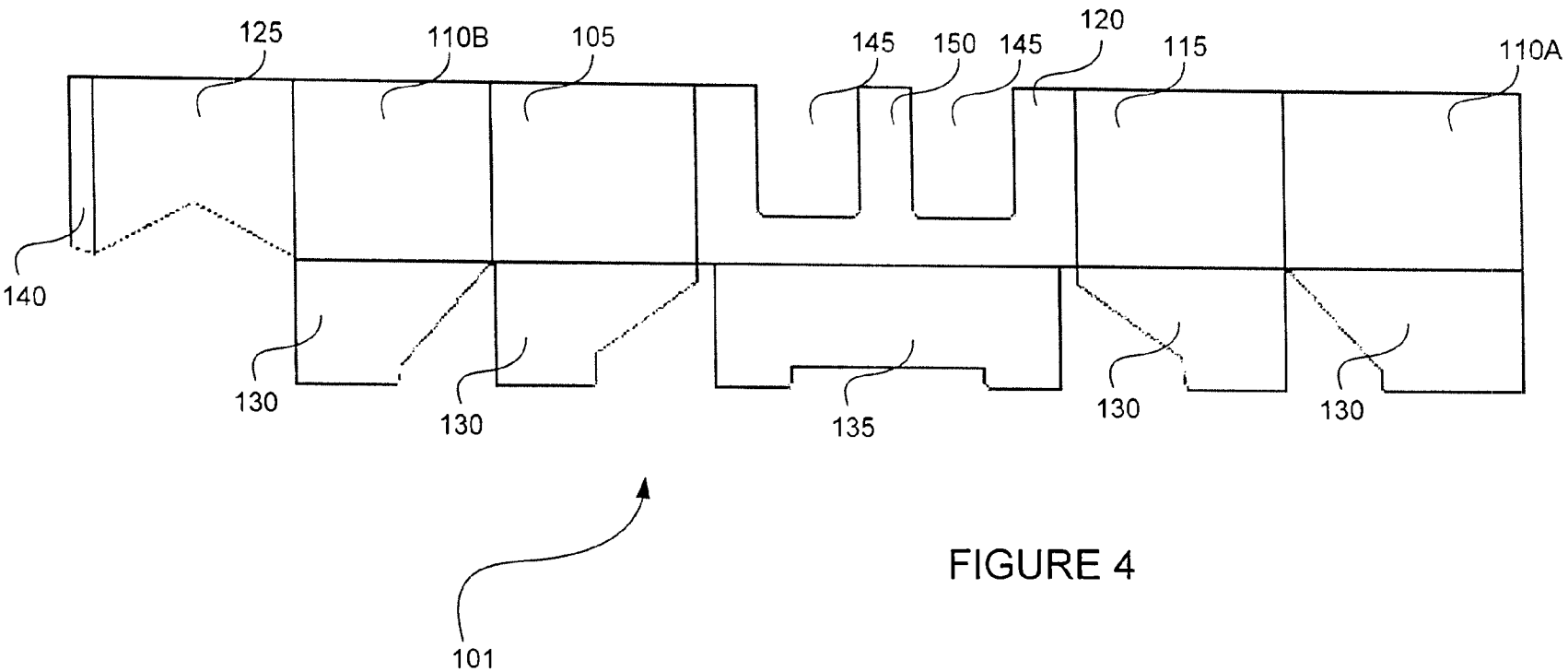

The blank 101 may also include scored holes 155 for enabling an individual to carry the container 100 once finally assembled. Alternatively, as illustrated in FIG. 4, the scored holes 155 may be omitted.

Figure 5:
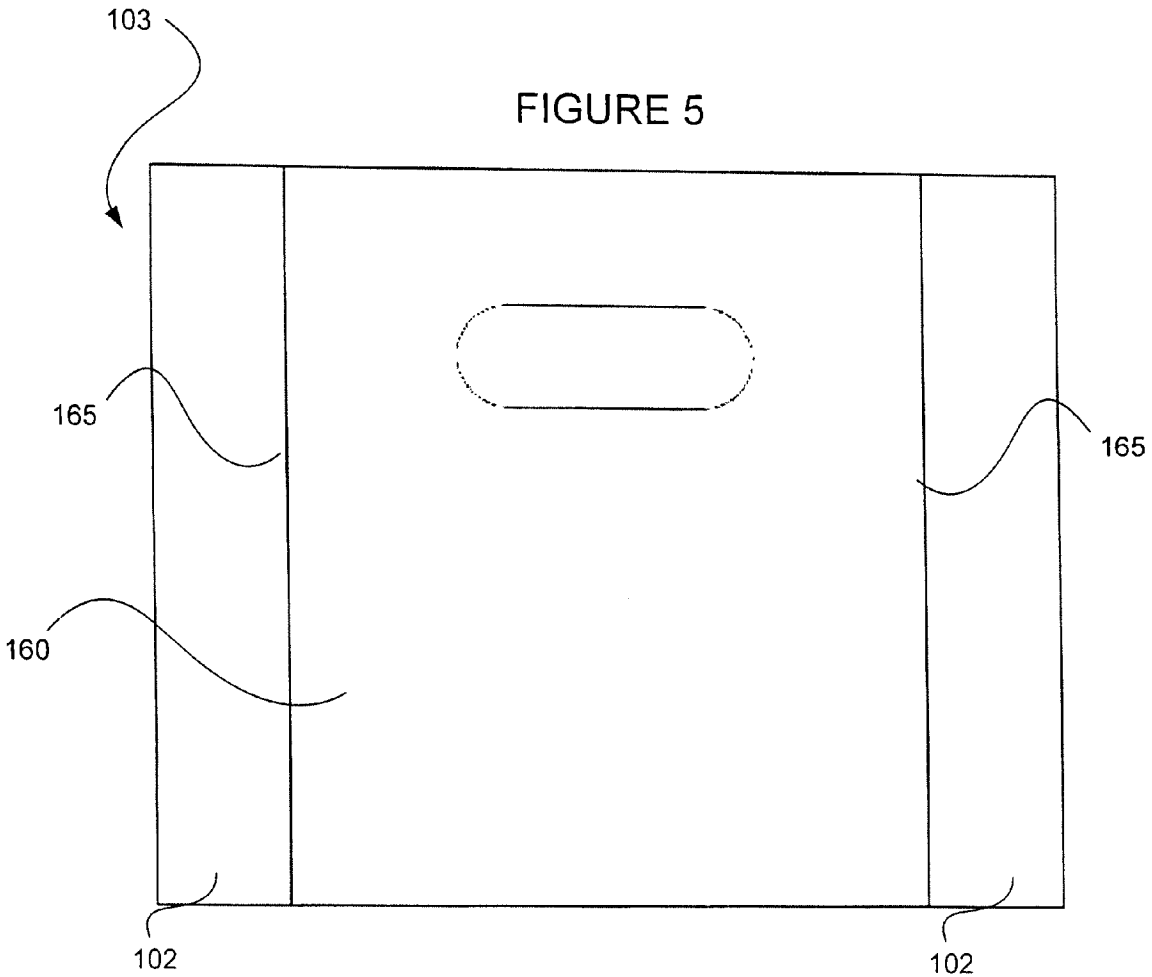

FIG. 5 illustrates an example of second type of blank, supplementary blank 103, used to provide the auxiliary support sections 102 illustrated in FIG. 1. The auxiliary support sections 102 are divided from the central blank section 160 by scoring lines 165 that enable bending of the material of the blank 103 along those lines 165 during final assembly of the container 100. This deformation or bending of the blank 103 enables the entire width of the blank 103 to fit in the interior confines of the assembled primary blank 101 (illustrated in FIGS. 3-4) so as to be substantially parallel to the side panels 105, 115 although the width dimensions of the blank 103 are greater than that of the side panels 105, 115. Although the blank 103 includes the slotted hole opening for overlapping the scored hole opening 155 illustrated in FIG. 3, the scored hole opening of blank 103 may be omitted if the blank 101 does not include corresponding scored hole openings.

As part of manufacturing of the pre-assembly for container 100, a section 160 of the supplementary blank 103 is affixed to one or both of the interior faces of the side panels 105, 115.

The faces may be affixed in one or more suitable manners including application of adhesive on one or both of the affixed faces, use of staples, tape, etc. At least a portion of the central section 160 of each of the blanks 103 is affixed to one of the side panels 105, 115, thereby leaving the support sections 102 to remain free to bend back towards the interior of the container 100 following final assembly. Accordingly, the auxiliary support sections 102 are bent back towards the interior of the container 100 and make contact with the neighboring sides of the primary blank 101, e.g., the front panel 120 and/or the back panel 110A-B (as illustrated in FIG. 6 showing a finally assembly container 100) during final assembly. Thus, each of the auxiliary support sections 102 are affixed at only one lateral end thereof to the corresponding side panel and rigidly (e.g., without bending or substantial deformation) abut or be adjacent to either the front and/or back panel at the other lateral end of the auxiliary support section 102.

Thus, following final assembly, the container 100 is thus formed in a rectangular configuration, with the side panels 105, 115 and back panels 110A-B and front panel 120 forming a pair of opposing walls. Further, the container 100 includes both increased strength on the side panels by the central section 160 of blank 103 affixed to the side panels 105, 115 and the inclusion of the auxiliary support sections 102 at the corners of the container 100, wherein the various side panels intersect. Therefore, it should be appreciated that this embodiment provides a plurality of auxiliary support sections 102 extending diagonally across respective corners of the container 100 planarly.

Although FIGS. 1-6 illustrate one example of a container that may be manufactured in accordance with illustrated embodiments, various different types of blanks and pre-assemblies may be used to produce various different types of containers. Thus, although one or more of the side panels may be configured in a rectangular shape, various other shapes are also suitable. Further, although not illustrated in FIGS. 1-6, a blank used to construct the exterior of the container may also include a top panel of various suitable shapes and sizes.

Figure 7:
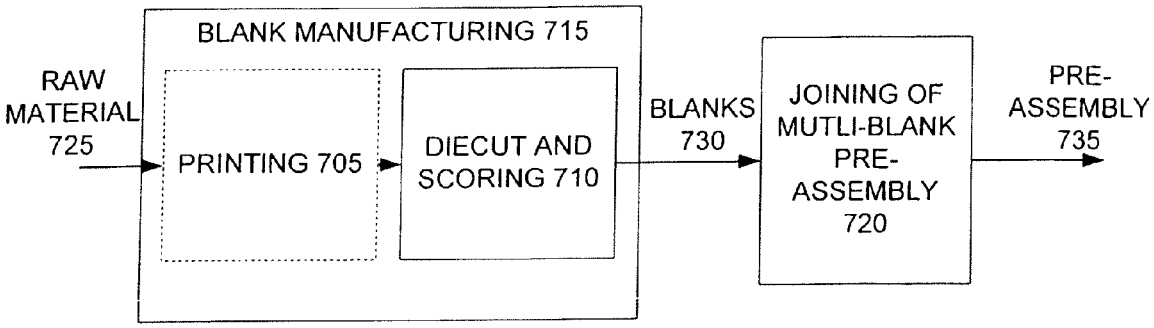

FIG. 7 illustrates a functional block diagram showing the operation of various method functions performed in accordance with a method of producing pre-assemblies in conjunction with illustrated embodiments. With regard to the manufacturing of containers such as the one illustrated in FIGS. 1-6, the manner of manufacturing such containers may be conveniently described in two phases: pre-assembly and final assembly/use.

Pre-assembly is normally performed at a container manufacturing facility to produce a pre-assembly, which may also be thought of and referred to as a knock-down of the container. These pre-assemblies may be shipped to a customer location such as a product manufacturing facility. At the product manufacturing facility, the customer may perform final assembly/use of the containers by, for example, folding and assembling various panels of the container to provide a container that is configured to hold manufacture product, e.g., for shipping and/or display.

In such operations, the labelling of the resulting containers may be performed by the customer of the pre-assemblies and/or as part of manufacture of the pre-assemblies as illustrated in FIG. 7.

FIG. 7 illustrates various functional operations performed as part of the manufacture of a pre-assembly by, for example, a container manufacturer. The operations may begin, for example, with printing 705 of container material prior to the container material being die cut and/or scored 710 as part of an overall blank manufacturing operation 715. The manufactured blanks 730 may or may not be printed on one or both sides of the blanks 730 depending on customer requirements. Accordingly, the printing operation 705 may be omitted.

Subsequent to blank manufacturing 715, multi-blank pre-assembly operations may be performed in various suitable manners by hand or using various commercially available machines (for example, those produced by Bahmueller Technologies, Inc. of Charlotte, N.C., USA or Bobst Group North America of Roseland, N.J., USA), to produce pre-assemblies for reinforced containers such as that illustrated in FIG. 1-6 and 8-38, for example.

Thus, at the beginning of such operations, raw material 725 is used to produce blanks 730. Such raw materials 725 may include but are not limited to various grades, types, configurations and combinations of corrugated fiberboard and/or solid paperboard, liner board, board of various fluting types and combinations as well as various types of sealants, non-organic materials and inks and dies of various suitable types.

It should be understood that implementation of the method and system of the present invention involves performing or completing certain selected tasks or steps manually, automatically, or a combination thereof.

While the invention has been initially described in conjunction with the specific embodiments outlined above, it should be evident that many alternatives, modifications and variations will be apparent to those skilled in the art. Accordingly, the various embodiments of the invention, as set forth above, are intended to be illustrative, not limiting. Various changes may be made without departing from the spirit and scope of the invention. Thus, it should be understood that containers come in many different varieties but most packaging containers can be folded and assembled from a flat form, known as a blank or pre-assembly. Accordingly, it should be understood that the pattern for any blank, pre-assembly or container may be different than those initially described herein.

For example, FIG. 8 illustrates a side perspective view of another container manufactured in accordance with an illustrated embodiment. As illustrated in FIG. 8, the container 200 may include one or more auxiliary support sections 202 affixed at the corners of the container 200, which in this illustrated example is a dual-use container of the type referred to in the packaging industry as a half regular, carton with cut-outs for display purposes (however, it should be understood that the manufactured container may be any type of carton, package, box, etc. of any suitable type).

As illustrated in FIG. 8, the container 200 is similar to that illustrated in FIG. 1, however, the support sections 202 of supplementary blank 203 are joined together via one or more panels so as to provide a single supplementary blank 203 (as illustrated in more detail in FIG. 10) that may be joined with the primary blank 201 (illustrated in more detail in FIG. 9) in such a manner as to provide a plurality of support sections 202 affixed to the blank 201. Like other illustrated embodiments, such support sections 202 may further improve strength and stackability of a resulting container 200.

As explained in connection with FIG. 10, the auxiliary support sections 202A-D are hingedly connected (e.g., coupled together so as to allow alteration of the angle therebetween) to central sections 260A-C. In this illustrated embodiment, the auxiliary support sections 202A-D are formed as part of the pre-assembly manufacturing process from blank 201 once blanks 201, 203 have been affixed together (as explained in conjunction with FIGS. 11-13).

Figure 9:
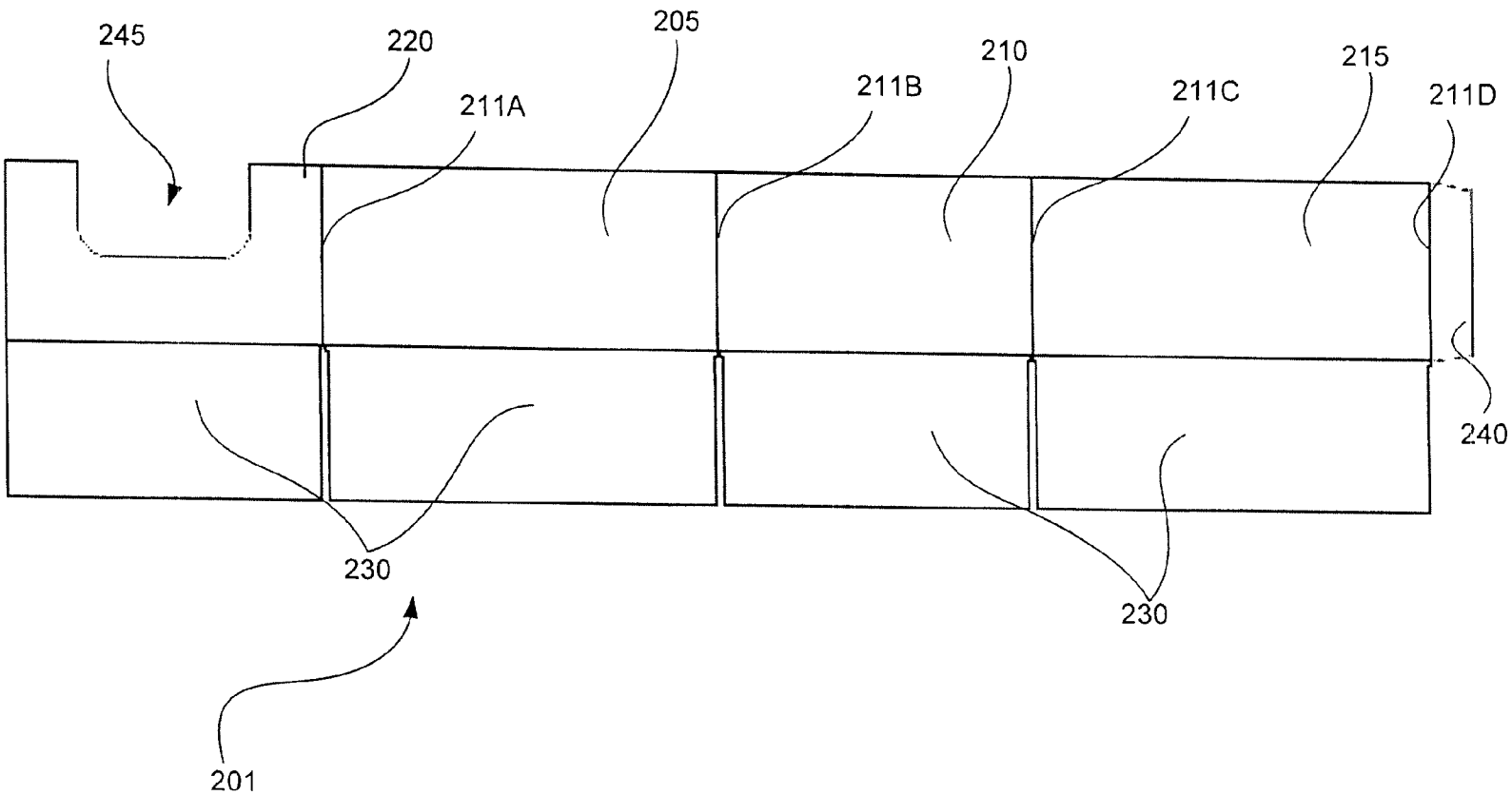

FIG. 9 illustrates an example of a primary blank 201 for what is conventionally known as a half regular carton such as the one illustrated in FIG. 8. As shown in FIG. 9, the primary blank 201 includes four panels: first and second side panels 205, 215, a back panel 210 and a front panel 220 separated by fold lines 211A-C. The blank 201 also includes four bottom sub-panels 230, which cooperate and interact to form a bottom panel when the container 200 is finally assembled. An adhesive panel 240, separated from side panel 215 by fold line 211D, is used as part of pre-assembly manufacturing to affix the edge of the side panel 215 with the edge of front panel 220. Accordingly, as part of pre-assembly manufacturing (explained herein), the adhesive panel 240 is positioned so as to overlap the front panel 220 and adhesive is applied to the overlapping areas so as to affix the overlapping areas to one another.

A display cut-out 245 may be provided in the front panel 220 of the primary blank 201; accordingly, although not shown the cut-out may be formed when a perforation is used to remove material (not shown) from the container 200 so as to provide an access opening for ready access to product displayed in the container 200. This opening 245 may be in communication with the open top end of the container 200, which (during use as a display) may be free of any top wall or panel following modification of the container 200 for the display function of the dual-use container. It should be appreciated that the opening 245 may be omitted, for example, if the container is to be used only as a shipping container.

Figure 10:
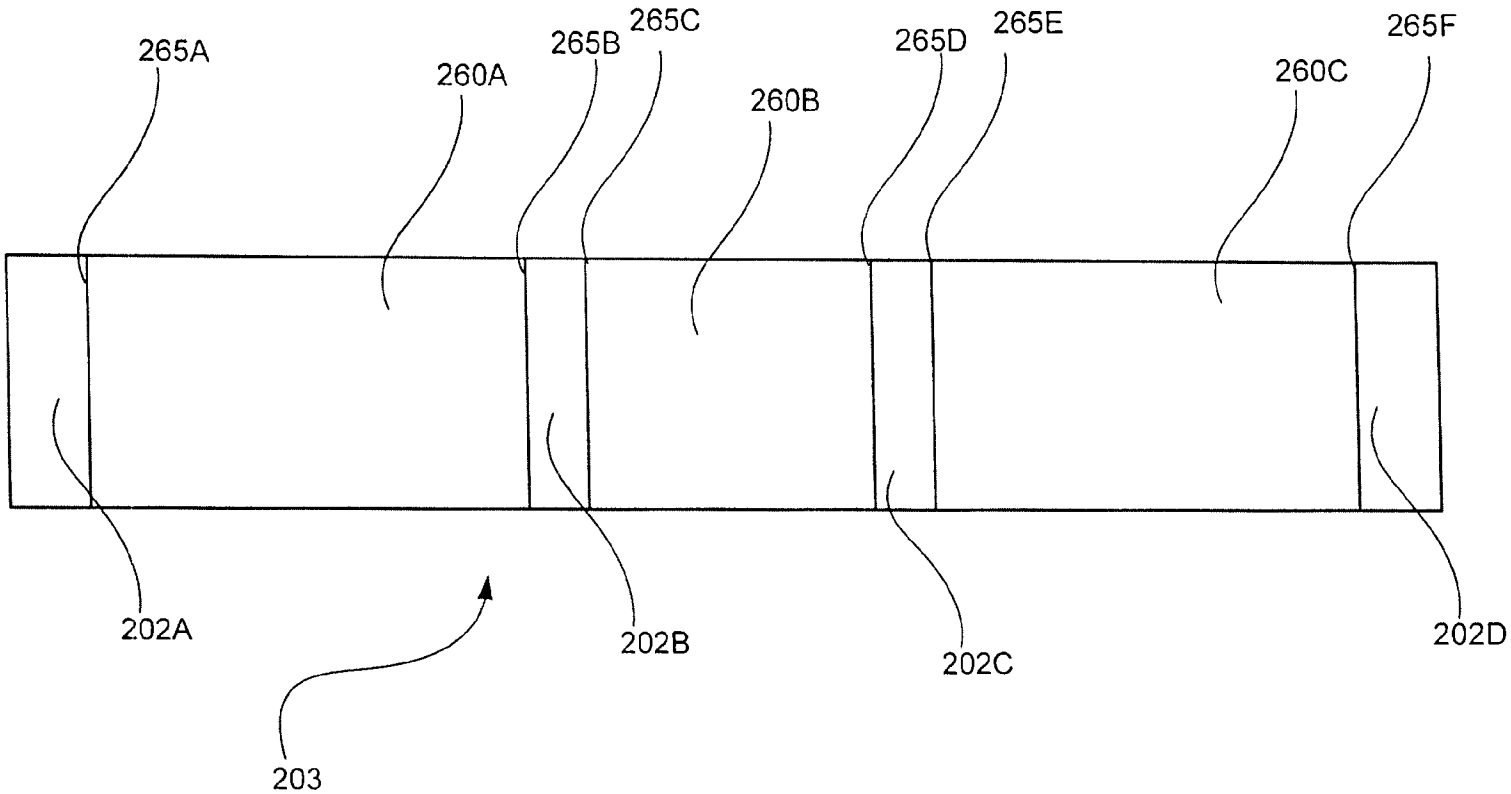

FIG. 10 illustrates an example of a second type of blank, supplementary blank 203, used to provide the auxiliary support sections 202 illustrated in FIG. 8. As explained above, the auxiliary support sections 202 are each hingedly connected (e.g., coupled together so as to allow alteration of the angle therebetween) to central sections 260A-C so as to provide a single blank 203 that provides all of the auxiliary support sections 202. Accordingly, as part of pre-assembly manufacturing any one or more of the central sections 260A-C may be affixed to corresponding lateral sides 205, 210, 215 of the primary blank 201 (illustrated in FIG. 9).

For example, one central section (e.g., 260B) of the central sections 260A-C or two non-neighboring central sections (e.g., 260A, 260C) may be affixed to the blank 201; however, particular utility may be provided by affixing the two non-neighboring central sections 260A and 260C to the primary blank 201 via adhesive 213 (illustrated in FIG. 14).

It should be appreciated that the primary blank 201 and the supplementary blank 203 may be affixed to one another at various different locations to form a pre-assembly. For example, only one central section (e.g., 260B) of the central sections 260A-C of the supplementary blank 203 may be affixed to a corresponding location (e.g., panel 210) of the primary blank 201. Alternatively, two non-neighboring central sections (e.g., 260A, 260C) of the supplementary blank 203 may be affixed to the corresponding panels (e.g., panels 205, 215 respectively) of the primary blank 201. Thus, as part of pre-assembly manufacturing, one or more of the central sections 260A-C of the blank 203 is affixed to one or more of the interior faces of the side panels 205, 210, 215. Regardless of which configuration for affixing the primary and supplementary blanks 201, 203 is used, the opening of the pre-assembly 200 results in the support sections 202A-D extending diagonally along the corners of the container 200 during final assembly of the container 200 from the pre-assembly.

The faces of the primary and supplementary blanks 201, 203 may be affixed to each other in one or more suitable manners including application of adhesive on one or both of the affixed faces, use of staples, tape, etc. However, of particular utility may be the use of adhesive to attach the blanks 201, 203 together; such an adhesive may be selected from various different types of adhesives that enable varying speeds of set times and strengths of adherence. For example, the blanks 201, 203 may be adhered to one another using an adhesive that may be what is referred to in the packaging industry as a "cold-set" adhesive, meaning that the adhesive is not heated prior to application. Such adhesives generally take longer to set, i.e., provide adherence of the materials being joined; however, such adhesives also generally provide a relatively strong bond. Cold-set adhesives differ from what are referred to as "hot-melt" adhesives, which generally set relatively faster but provide a relatively weaker bond.

Thus, it should further be appreciated that cold-set adhesives provide for the ability to alter positioning by, for example, a lateral sliding movement, immediately following initial contact between the blanks 201, 203. Therefore, it should be understood that the folding operations performed as part of pre-assembly manufacture and explained herein with reference to FIGS. 11-15 may result in some lateral sliding movement between the blanks 201, 203 during the pre-assembly folding operations.

Figure 11:
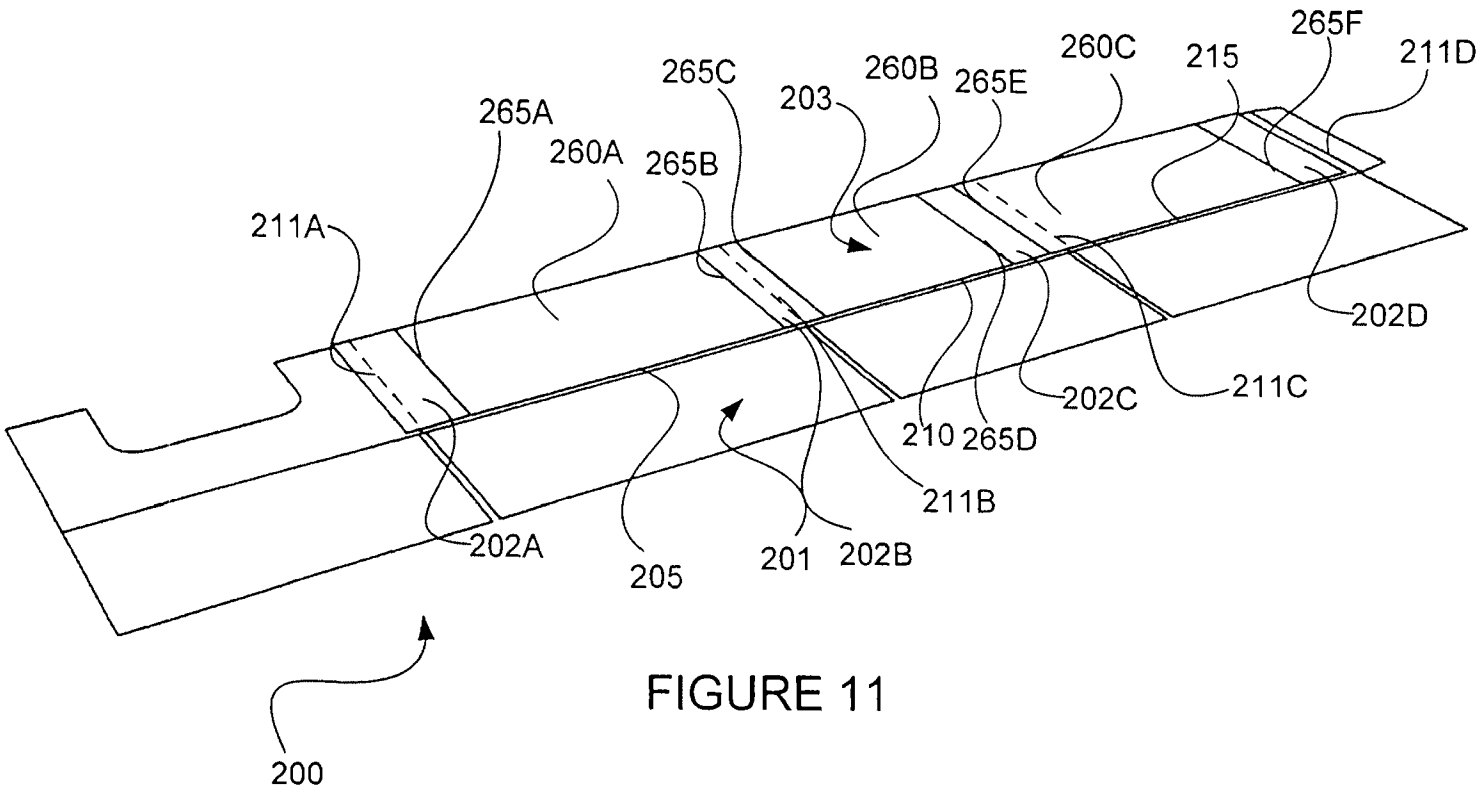

Thus, as shown in FIG. 11, the initial positioning of the blanks 201, 203 relative to each other may result in the fold lines 265A-265F of blank 203 not overlapping any of the fold lines 211A-D of blank 201 (shown in FIG. 9). However, as illustrated in FIG. 12, as the panel 215 is folded towards the remaining panels of blank 201 along fold line 211C, the combination of the blanks 201, 203 may experience some lateral sliding in the direction of the arrow relative to each other such that the fold lines 211C and 265E shift relative to each other.

Figure 12:
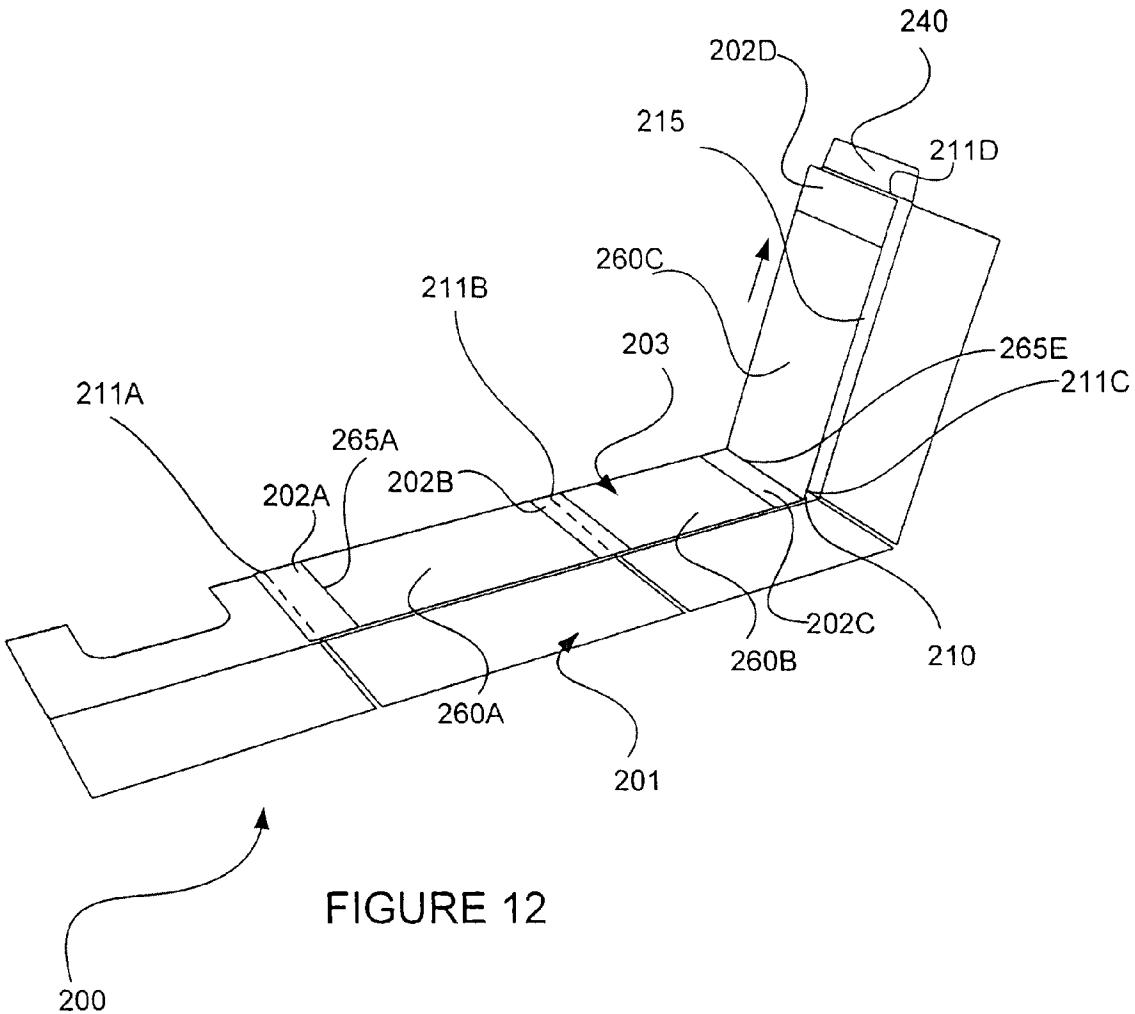

As a result, as shown in FIG. 12, the glued central section 260C of blank 203 may be moved in the direction of the arrow with reference corresponding panel 215 of blank 201. Subsequently, the support section 202 may extend beyond the glue panel 240 on primary blank 201. Therefore, a comparison between the pre-assembly at stages of assembly illustrated in FIGS. 12 and 13 should indicate that some lateral movement between the panels of the blanks 201, 203 occurs during folding. Note, as illustrated in FIGS. 12-13 particularly and in other corresponding figures for other embodiments, the dashed lines indicate the location of fold lines on the primary blank although those fold lines would not be visible at this stage of pre-assembly manufacture.

As shown in FIG. 13, following the folding over of panel 215 along fold line 211C, the front panel 220 is folded towards the other panels of the blank 201 along fold line 211A as illustrated in FIG. 14.

As shown in FIG. 14, following folding of at least some of the panels of primary blank 201, the fold lines 211A-E and fold lines 265A-C are realigned relative to one another, such that the auxiliary support section 202C is positioned so as to overlap the corner formed between the back panel 210 and side panel 215 produced at fold line 211C.

Following folding of the panels of the primary blank 201, the front panel 220 comes into contact with the adhesive panel 240, which may be carrying some type of adhesive (not shown) so as to adhere the edge of the front panel 220 to the edge of the side panel 215. As a result of these folding operations and the adherence between the blanks 201, 203, the pre-assembly illustrated in FIG. 15 is produced.

Thus, as illustrated in FIGS. 11-15, manufacture of a pre-assembly is described in an exemplary manner wherein the non-neighboring central sections 260A, 260C of blank 202 are affixed to the side panels 205, 215 of blank 201. As in other illustrated embodiments, the blank 203 has relative dimension with respect to blank 201 such that bending of the material of the blank 203 enables the sections 260A-C of the blank 203 to each fit along the corresponding panel (e.g., 205, 210, 215) of the interior confines of the container 200. As a result of this sizing, the sections 260A-C of the blank 203 fit substantially parallel to the side panels 205, 210, 215 respectively.

As a result of this cooperation of the components of blanks 201 and 203 one or more optional air cells 270 may be created in the container 200 as illustrated in FIG. 15. For example, the central section 260B and the corresponding panel 210 may be separated following final assembly of the container to provide the air cell 270. It should be appreciated that, depending on the width dimensions of the sections 260A-C and 202A-D and width dimensions of the panels 205, 210, 215, an air cell 270 may or may not be created based on the relative dimensions of those groups of widths. A finally assembled container 200 is thus formed in a rectangular configuration, with the panels 205 210, 215 and front panel 220 forming a pair of opposing walls. Further, the container includes both increased strength on the side panels 205, 215 and end panel 210 by both the auxiliary support sections 202A-D at the corners of the container 200, wherein the various side panels intersect, as well as the optional air cell 270 provided along one or more of the panels 205, 210, 215. Therefore, it should be appreciated that this embodiment provides a plurality of auxiliary support sections 202A-D of the supplementary blank 203 extending diagonally across respective corners of the container 200 planarly.

As with FIGS. 8-16, FIGS. 17-23 illustrate another example of a container that may be manufactured in accordance with an illustrated embodiment. As with the other illustrated embodiments, various different types of blanks and pre-assemblies may be used to produce various different types of containers. As shown in FIG. 17, a container 300 may be provided that includes two different types of auxiliary support sections 302 and 304. The auxiliary support sections 302 are similar in appearance to the support sections 102 and 202 of other illustrated embodiments (see FIGS. 1 and 8 respectively); however, the auxiliary support panels 304 are different in that they are each rectangular column-like corner supports formed by the folding of two constituent panels of a primary blank 301.

Like the other illustrated embodiments, the container 300 is formed by the joining of a primary blank 301 (as illustrated in FIG. 18) and at least one supplementary blank 303 (as illustrated in FIG. 19). As shown in FIG. 20, the container 300 includes two supplementary blanks 303 joined to corresponding panels of the primary blank 301 to provide both types of auxiliary supports 302 and 304. Although not discussed in detail, it should be appreciated that blanks used in this illustrated embodiment, like any of the other illustrated embodiments, may be joined using any conventionally known mechanism including, in particular, cold set and/or hot melt adhesives.

As shown in FIG. 18, the primary blank 301 includes side panels 305 and 315, a back panel 310 and a front panel 320, which includes a cut-out 345 suitable for providing an opening for access to stored product. The panels 305-320 along with adhesive panel 340 are separated from each other by fold lines 311A-D.

The blank 301 also includes four bottom sub-panels 330 that cooperate to form a bottom of the container 300 following final assembly as well as two types of top sub-panels 375, 380. The sub-panels 375 differ from the sub-panels 380 in that the sub-panels 380 include a perforation line 385 that lines up with the perforation lines corresponding to the cut-out 345 when the container 300 is finally assembled. The cooperation of the perforation lines 385 and the perforation for the cut-out 345 provide the ability to provide an access opening in the container 300 when the container is used as a display container. To that end, the cut-out 345 may optionally include an aperture or aperture perforation 395 that further enables easy removal of the cut-out 345 and portions of the top sub-panels 380.

FIG. 19 illustrates another example of a blank, supplementary blank 303 used in manufacturing the container of the type illustrated in FIG. 17. As shown in FIG. 19, the blank 303 may be used to form the supports on one side of the container 300, i.e., 302, 304 (or as illustrated in more detail respect to FIG. 21, 302B, 304B or 302A, 304A). Thus, as shown in FIG. 19, the blank 303 includes both the section 302, which is configured to form the support sections 302B, 302A of FIG. 21. Likewise, the blank 303 also includes sections for the other type of supports 304; more specifically, sections 306, 308 serve as two sides of each of the rectangular column shaped support sections 304 with a corner between those two sides being formed along the fold line 365B. Both the two corner support sub-sections 306, 308 of the rectangular column support section 304 and the diagonal shape of the support section 302 are formed by the interaction between the blanks 301, 303 following the blanks being joined together.

Accordingly, the supplementary blank 303 includes an end section 360A and a central section 360B that serve as locations for affixing the blanks 301, 303 together. Thus, in an illustrated embodiment, the end section 360A includes adhesive 313A and the central section 360B includes adhesive 313B for affixing the sections 360A, 360B to the primary blank 301. As shown in FIG. 19, the end section 360A is separated from the section 306 of the support 304 by a fold line 365A; likewise, the section 308 is separated from the central section 360B by the fold line 365C. Further, the central section 360B is separated from the corner support section 302 by the fold line 365D.

As illustrated in FIG. 20, an end section 360A of the other supplementary blank 303B is affixed to the front panel 320 while the corresponding central section 360B is affixed to the front panel 315. Likewise, the end section 360A of one supplementary blank 303A is affixed to the back panel 310 while the corresponding central section 360B is affixed to side panel 305.

It should be understood from FIGS. 19-21, that the fold line 365A on one of the supplementary blanks 303A does not overlap the fold line 311A between the side panel 305 and the end panel 310. Likewise, the fold line 365A on the other supplementary blank 303B does not overlap the fold line 311C between the front panel 320 and the side panel 315. This offset is provided so as to force the supports 304A-B to form during final assembly of the container 300; this is because, following joining of the primary and supplementary blanks 301, 303, as the side panel 315 is folded towards the other panels of the primary blank 301 along fold line 311C, the supplementary blank 303B is forced to fold along fold lines 365A-C to form the rectangular column shaped corner support 304B as shown in FIG. 21. Likewise, as the end panel 310 is folded towards the other panels of the primary blank 301 along fold line 311A, the other supplementary blank 303A is forced to fold along fold lines 365A-C to form the rectangular column shaped corner support 304A. Subsequent to the folding over of the side panel 315 and folding over of the end panel 310, adhesive carried on the adhesive panel 340 is used to join the side and end panels 310, 315 to one another and provide the completed pre-assembly as shown in FIG. 22.

Thus, when the pre-assembly 300 is finally assembled, as shown in FIG. 23, the sub-sections 306, 308 of each of the rectangular column shaped supports 304B, 304A are positioned at or near right angles to one another while the neighboring sections 360A and 360B provide coupling of the subsections 306, 308 to the corner formed by panels of the primary blank 301. Simultaneously, the diagonal corner supports 302B, 302A are formed in the remaining, opposing corners by the force imposed on the support section 302 of each of the supplementary blanks 303 when the primary blank panels are configured as the exterior of the container 300. Therefore, it should be appreciated that this embodiment provides at least one auxiliary support section 302 of the supplementary blank 303 extending diagonally across at least one corner of the container 300 planarly and at least one other auxiliary support section 304 extends diagonally across at least one corner of the container 300 non-planarly.

As with FIGS. 17-23, FIGS. 24-30 illustrate yet another example of a container that may be manufactured in accordance with an illustrated embodiment. As with the other illustrated embodiments, various different types of blanks and pre-assemblies may be used to produce various different types of containers. As shown in FIG. 24 a container 400 may be provided that includes two different types of auxiliary supports 402 and 404. The auxiliary support sections 402 are similar in appearance to the support sections 102, 202, 302 of other illustrated embodiments (see FIGS. 1, 8 and 17 respectively); however, the auxiliary support sections 404 are different. More specifically, the auxiliary support sections 404 are each rectangular, truncated, column-like supports formed by the folding of two constituent sections provided on a primary blank 401 and similar to the auxiliary support 304 of FIG. 23, as explained herein.

Like the other illustrated embodiments, the container 400 is formed by the joining of a primary blank 401 (as illustrated in FIG. 25) and at least one supplementary blank 403 (as shown in FIG. 26). As shown in FIG. 27, the container 400 includes two supplementary blanks 403 joined to corresponding panels of the primary blank 401 to provide both types of auxiliary supports 402 and 404. Although not discussed in detail, it should be appreciated that the blanks used in this illustrated embodiment like any of the other illustrated embodiments may be joined using any conventionally known mechanism including, in particular, cold set and/or hot melt adhesives.

As shown in FIG. 25, the primary blank 401 includes side panels 405 and 415, a back panel 410 and a front panel 420, which includes an optional cut-out 445 suitable for providing an opening for access to stored product. Together, the panels 405-420 and an adhesive panel 440 are separated by fold lines 411A-D. The blank 401 also includes four bottom sub-panels 430 that cooperate to form a bottom of the container 400 following final assembly as well as top sub-panels 475. It should be appreciated that, although not illustrated, some of the sub-panels 475 may include perforation lines like similar lines 385 illustrated in FIG. 18 that line up with the perforation lines corresponding to the cut-out 445 when the container 400 is finally assembled to provide the ability to provide an access opening in the container 400 when the container is used as a display container. Likewise, the cut-out 445 may optionally include an aperture or aperture perforation like perforation 395 illustrated in FIG. 18 and that further enables easy removal of the cut-out 445.

The primary blank 401 also includes the constituent panels for the rectangular shaped, truncated corner supports 404. More specifically, corner support 404A includes two panels 490A, 491A separated by a fold line 492A and sharing a bottom perforation line 493A; likewise, corner support 404B includes two panels 490B, 491B separated by a fold line 492B and sharing a bottom perforation line 493B. Note, the fold line 411A between the end panel 410 and the side panel 405 does not line up with the fold line 492A. Likewise, the fold line 411C between the side panel 415 and the front panel 420 does not line up with the fold line 492B.

FIG. 26 illustrates another example of a blank, supplementary blank 403, used in manufacturing the container of the type illustrated in FIG. 24. As shown in FIG. 26, the supplementary blank 403 may be used to form the diagonal support sections 402. Thus, as shown in FIG. 24, the blank 403 includes both the section 402, which is configured to form the support sections 402A, 402B (illustrated in FIGS. 28 and 30) and also includes a central section 460 separated from the support section 402 by a fold line 465. In an illustrated embodiment, the central section 460 includes adhesive (not shown) for affixing the section 460 to the primary blank 401.

As illustrated in FIG. 27, the central section 460 of one supplementary blank 403A is positioned to be affixed to the side panel 405 next to the corner section 491A while the corresponding central section 460 of the other supplementary blank 403B is affixed to side panel 415 next to the corner sub section 491B.

As noted above and should be understood from FIGS. 27-28, the fold line 411A between the end panel 410 and the side panel 405 does not line up with the fold line 492A. Likewise, the fold line 411C between the side panel 415 and the front panel 420 does not line up with the fold line 492B. Accordingly, as shown in FIG. 28, as the back panel 410 is folded towards the side panel 405 and the side panel 415 is folded towards the front panel 420, the perforation lines 493A and 493B tear so as to enable the corresponding corner subsections 490A, 491A and 491B, 491B to form the corner supports 404A, 404B respectively.

As in other illustrated embodiments, the diagonal corner supports 402 are formed by the sizing of the support sections 402 and the positioning of the support sections 402 so that the fold line 465 for each blank 403 is offset from the fold lines 411B or 411D (depending on which supplementary blank 403 is being considered).

Subsequent to the folding over of the side panel 415 along fold line 411C and folding over of the end panel 410 along fold line 411A, adhesive carried on the adhesive panel 440 is used to join the side and end panels 410, 415 to one another and provide the completed pre-assembly 400 as shown in FIG. 22.

When the pre-assembly 400 is finally assembled, as shown in FIG. 30, the sub-panels 490, 491 of each of the rectangular column shaped, truncated support panels 404A, 404B (i.e., 490A, 491A of the rectangular column shaped, truncated support panel 404A and 490B, 491B of the rectangular column shaped, truncated support panel 404B) are positioned at or near right angles to one another. Simultaneously, the diagonal corner supports 402A, 402B are formed in the remaining, opposing corners of the container 400 by the force imposed on the support section 402 of each of the supplementary blanks 403 (see FIG. 26) when the primary blank panels are configured as the exterior of the container 400. Therefore, it should be appreciated that this embodiment provides at least one auxiliary support section 402A and/or 402B of the supplementary blank 403 extending diagonally across at least one corner of the container 400 planarly and the container includes another auxiliary support panel 404A and/or 404B that extends diagonally across at least one corner of the container 400 non-planarly.

As with FIGS. 24-30, FIGS. 31-38 illustrate yet another example of a container that may be manufactured in accordance with an illustrated embodiment. As with the other illustrated embodiments, various different types of blanks and pre-assemblies may be used to produce various different types of containers. As shown in FIG. 31, a container 500 may be provided that includes two different types of auxiliary supports 502 and 508. The auxiliary support sections 502 are similar in appearance to the support sections 102, 202, 302 and 402 of other illustrated embodiments (see FIGS. 1, 8, 17 and 24 respectively); however, the auxiliary support panels 508 are different. More specifically, the auxiliary support panels 508 are actually formed from the exterior of the container; therefore, although for consistency, they may be termed "auxiliary" support panels, the support panels 508 may also be considered "primary" to the container 500 because they replace a conventional container corner (i.e., a location where two planes meet). Additionally, as explained herein, the support panels 508 are formed by the folding of the constituent panels provided on a primary blank as explained herein.

Like the other illustrated embodiments, the container 500 is formed by the joining of a primary blank 501 (as illustrated in FIG. 32) and at least one supplementary blank 503 (as shown in FIG. 33). As shown in FIG. 34, the container 500 includes two supplementary blanks 503 joined to corresponding panels of the primary blank 501 to provide both types of auxiliary supports 502 and 508. Although not discussed in detail, it should be appreciated that the blanks used in this illustrated embodiment like any of the other illustrated embodiments may be joined using any conventionally known mechanism including, in particular, cold set and/or hot melt adhesives.

As shown in FIG. 32, the primary blank 501 includes side panels 505 and 515, a back panel 510 and a front panel 520, which includes a cut-out 545 suitable for providing an opening for access to stored product. The panels 505-520 together with an adhesive panel 540 are separated by fold lines 511A-F.

The blank 501 also includes two of each of two types of bottom sub-panels 530, 531, the two types differing in size but cooperating to form a bottom of the container 500 following final assembly. The primary blank 501 also includes two of each of two types of top sub-panels 575, 580, the two types differing in that the sub-panels 585 include perforation lines 585. The panels 575, 580 cooperate to form a top of the container 500 following final assembly. As in the embodiment illustrated in connection with FIG. 18, the perforation lines 585 may line up with the perforation lines corresponding to the optional cut-out 545 when the container 500 is finally assembled to provide the ability to provide an access opening in the container 500 when the container is used as a display container. Likewise, the cut-out 545 may optionally include an aperture or aperture perforation like perforation 595 that further enables easy removal of the cut-out 545.

Like the embodiment illustrated in FIGS. 24-30, the primary blank 501 also includes constituent panels for at least some of the corner supports. More specifically, corner supports 508 (be they considered auxiliary or primary to the container) are each formed by the panels 508A-B which are included in the primary blank 501.

FIG. 33 illustrates another example of another blank, supplemental blank 503, used in manufacturing the container of the type illustrated in FIG. 31. As shown in FIG. 33, the supplementary blank 503 may be used to form the diagonal support sections 502. Thus, as shown in FIG. 31, the supplementary blank 503 includes both the section 502, which is configured to form the support sections 502A, 502B (shown in FIGS. 34-36 and 38), and includes a central section 560 separated from the support section 502 by a fold line 565. In an illustrated embodiment, the central section 560 may carry adhesive (not shown) for affixing the section 560 to panels of the primary blank 501.

As illustrated in FIG. 34, the central section 560 of one supplementary blank 503A is positioned to be affixed to the side panel 505 next to the support panel 508A while the corresponding central section 560 of the other supplementary blank 503B is positioned to be affixed to side panel 515 next to the support panel 508B.

As noted above and should be understood from FIGS. 34-35, the fold line 511C between the front panel 520 and the side panel 505 does not line up with the fold line 565 between the central section 560 and the corner support 502A of the supplementary blank 503A. Likewise, the fold line 511F between the side panel 515 and the glue panel 540 (which becomes the fold line between the side panel 515 and the back panel 510 following assembly) does not line up with the fold line 565 on supplementary blank 503B.

As shown in FIG. 36, the back panel 510 is folded towards the side panel 505 along fold line 511B and the end panel 515 is folded towards the front panel 520 along fold line 511E. Subsequently, adhesive carried on the adhesive panel 540 is used to join the side and end panels 510, 515 to one another and provide the completed pre-assembly 500 as shown in FIG. 37.

When the pre-assembly 500 is finally assembled, as shown in FIG. 38, the diagonal support sections 502A-B are formed by the sizing and positioning of the support sections 502 of the supplementary blank 503 so that the fold line 565 for each blank 503 is offset from the fold lines 511C and 511F between the side and end panels 505-520 of the primary blank 503.

Thus, the support panels 508 are formed to replace the conventional container corners and provide added stacking strength for the container 500. Likewise, the diagonal supports sections 502 are formed in the remaining, opposing corners by the force imposed on the support section 502 of each of the supplementary blanks 503 when the primary blank panels are configured as the exterior of the container 500.

Therefore, it should be appreciated that this embodiment provides at least one auxiliary support section 502 of the supplementary blank 503 extending diagonally across at least one corner of the container 500 planarly and the container 500 includes at least one other auxiliary support panel 508 that extends diagonally across at least one corner of the container 300 planarly.

It should be understood that invention embodiments are capable of variations practiced or carried out in various ways. Therefore, it should be appreciated that, in accordance with at least one embodiment of the invention, any and all of the walls may be constructed of corrugated cardboard. However, it should be understood that the walls, panels, any tabs on various panels, etc., may be constructed of various industry recognized appropriate materials that meet various transporting and/or display criteria. As a result, it should be understood that containers manufactured in accordance with at least one embodiment of the invention may also be considered "cartons," which may be considered packaging containers, commonly made from cardboard.

It should also be understood that illustrated invention embodiments may result in pre-assemblies that may be finally assembled for use as containers using conventionally known auto-erector machinery that finally assembles containers with minimal or no human operator involvement.

Alternatively, or more specifically, the packaging containers may be made using corrugated board, e.g., material made by a corrugator (a machine that produces corrugated board by attaching fluting to liners) which is a structured board formed by gluing one or more arched layers of corrugated medium to one or more flat-facing linerboards.

Additionally, it should be appreciated that material used in accordance with at least one embodiment of the invention may be laminated to provide barrier properties. Further, other barrier materials may be used including Ultra Violet (UV), moisture and gas barriers. Additionally, though not discussed in great detail herein, it should be understood that any adhesive used to provide a bond between materials used in containers provided in accordance with the invention may include any substance that helps bond two materials together, examples including but not limited to glue and paste.

It should also be appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

Additionally, it should be understood that the functionality described in connection with various described components of various invention embodiments may be combined or separated from one another in such a way that the architecture of the invention is somewhat different than what is expressly disclosed herein. Moreover, it should be understood that, unless otherwise specified, there is no essential requirement that methodology operations be performed in the illustrated order; therefore, one of ordinary skill in the art would recognize that some operations may be performed in one or more alternative order and/or simultaneously.

As a result, it will be apparent for those skilled in the art that the illustrative embodiments described are only examples and that various modifications can be made within the scope of the invention as defined in the appended claims.

The invention claimed is:

1. A method of manufacturing a container, the method comprising:

cutting a primary blank including a front panel, back panel, two side panels and at least one bottom panel;

cutting at least one supplementary blank including at least one central section and at least one auxiliary support extending from the central section; and affixing the at least one central section of the at least one supplementary blank to one of the panels of the primary blank to provide a pre-assembly for the container such that:

the at least one auxiliary support extends past a lateral edge of the one panel;

when the container is finally assembled, the at least one auxiliary support extends diagonally across a corner of the container formed by the one panel and an adjacent panel of the panels:

wherein cutting a supplementary blank further comprises cutting two supplementary blanks each including at least one central section and at least one auxiliary support extending from the central section; and the affixing of the at least one central section of the at least one supplementary blank to one of the panels of the primary blank further comprises affixing the central section of each supplementary blank to a corresponding panel of the primary blank such that:

at least one of the auxiliary supports for each supplementary blank extends past a lateral edge of the corresponding panel;

when the container is finally assembled, the at least one of the auxiliary supports for each supplementary blank extends diagonally across a corner of the container formed by the corresponding panel and the adjacent panel; and wherein the cutting the primary blank includes forming a strip extending across a border of two of the panels and forming a fold line transverse to and displaced from the border such that, when the container is finally assembled, the strip extends across and is spaced apart from a corner of the container formed by the two panels.

2. The method of claim 1, wherein the supplementary blank is cut to include two auxiliary supports extending from opposite sides of the central section; and the central section of the supplementary blank is affixed to the one panel of the first blank such that:

each one of the auxiliary supports extends past an opposed lateral edge of the one panel; and when the container is finally assembled, each one of the auxiliary supports extends diagonally across a corner of the container formed by the one panel and the adjacent panel.

3. The method of claim 1, wherein the central section of each supplementary blank is affixed to the corresponding panel of the primary blank such that the auxiliary supports extend across diagonally opposed corners of the assembled container.

4. The method of claim 1, wherein the auxiliary supports and the panels are cut to have the same height.

5. The method of claim 1, wherein the primary and supplementary blank are affixed to one another via application of an adhesive.

6. The method of claim 1, wherein, when the container is finally assembled, at least one air cell is provided between at least one central section of the supplementary blank and a corresponding side panel of the primary blank.

7. The method of claim 1, wherein the supplemental blank has a free end following affixing of the pre-assembly.

8. A container pre-assembly comprising:

a primary blank including a front panel, back panel, two side panels and at least one bottom panel; and at least one supplementary blank including at least one central section and at least one auxiliary support extending from the central section, wherein the at least one central section of the at least one supplementary blank and one of the panels of the primary blank are affixed together such that:

the at least one auxiliary support extends past a lateral edge of the one panel;

when the container is finally assembled, the at least one auxiliary support extends diagonally across a corner of the container formed by the one panel and an adjacent panel;

further comprising a second supplementary blank, wherein each of the supplementary blanks includes at least one central section and at least one auxiliary support extending from the central section; and wherein the central section of each supplementary blank is affixed to a corresponding panel of the primary blank such that:

at least one of the auxiliary supports for each supplementary blank extends past a lateral edge of the corresponding panel;

when the container is finally assembled, the at least one of the auxiliary supports for each supplementary blank extends diagonally across a corner of the container formed by the corresponding panel and the adjacent panel; and further comprising a strip extending across a border of two of the panels and forming a fold line transverse to and displaced from the border such that, when the container is finally assembled, the strip extends across and is spaced apart from a corner of the container formed by the two panels.

9. The container pre-assembly of claim 8, wherein the supplementary blank includes two auxiliary supports extending from opposite sides of the central section; and the central section of the supplementary blank is affixed to the one panel of the first blank such that:

each one of the auxiliary supports extends past an opposed lateral edge of the one panel; and when the container is finally assembled, each one of the auxiliary supports extends diagonally across a corner of the container formed by the one panel and the adjacent panel.

10. The container pre-assembly of claim 8, wherein the central section of each supplementary blank is affixed to the corresponding panel of the primary blank such that the auxiliary supports extend across diagonally opposed corners of the assembled container.

11. The container pre-assembly of claim 8, wherein the auxiliary supports and the panels have the same height.

12. The container pre-assembly of claim 8, wherein the primary and supplementary blank are affixed to one another via application of an adhesive.

13. The container pre-assembly of claim 8, wherein, when the container is finally assembled, at least one air cell is provided between at least one central section of the supplementary blank and a corresponding side panel of the primary blank.

14. The container pre-assembly of claim 8, wherein the supplemental blank has a free end following affixing of the pre-assembly.

15. A plurality of blanks for a container pre-assembly, the plurality of blanks comprising:

a primary blank including a front panel, back panel, two side panels and at least one bottom panel; and at least one supplementary blank including at least one central section and at least one auxiliary support extending from the central section, wherein the primary blank is configured to mate with and be affixed with the at least one supplementary blank so that:

the at least one auxiliary support extends past a lateral edge of the one panel;

when the container is finally assembled, the at least one auxiliary support extends diagonally across a corner of the container formed by the one panel and an adjacent panel;

further comprising a second supplementary blank, wherein each of the supplementary blanks includes at least one central section and at least one auxiliary support extending from the central section; and wherein the central section of each supplementary blank is affixed to a corresponding panel of the primary blank such that:

at least one of the auxiliary supports for each supplementary blank extends past a lateral edge of the corresponding panel;

when the container is finally assembled, the another one of the auxiliary supports for each supplementary blank is automatically formed extends non-diagonally across a corner of the container formed by the corresponding panel and the adjacent panel; and further comprising a strip extending across a border of two of the panels and forming a fold line transverse to and displaced from the border such that, when the container is finally assembled, the strip extends across and spaced apart from a corner of the container formed by the two panels.

16. The plurality of blanks of claim 15, wherein the supplementary blank includes two auxiliary supports extending from opposite sides of the central section; and the central section of the supplementary blank is affixed to the one panel of the first blank such that:

each one of the auxiliary supports extends past an opposed lateral edge of the one panel; and when the container is finally assembled, each one of the auxiliary supports extends diagonally across a corner of the container formed by the one panel and the adjacent panel.

17. The plurality of blanks of claim 15, wherein the central section of each supplementary blank is affixed to the corresponding panel of the primary blank such that the auxiliary supports extend across diagonally opposed corners of the assembled container.

18. The plurality of blanks of claim 15, wherein the auxiliary supports and the panels have the same height.

19. The plurality of blanks of claim 15, wherein the primary and supplementary blank are affixed to one another via application of an adhesive.

20. The plurality of blanks of claim 15, wherein, when the container is finally assembled, at least one air cell is provided between at least one central section of the supplementary blank and a corresponding side panel of the primary blank.

21. The plurality of blanks of claim 15, the supplementary blank is sized so as to extend beyond at least one lateral edge of at least one of the panels of the primary blank when the supplementary blank covers the at least one panel of the primary blank and is aligned with at least one other lateral edge of the at least one panel.

22. The plurality of blanks of claim 15, wherein the supplemental blank has a free end following affixing of the pre-assembly.

23. A method of manufacturing a container, the method comprising:

cutting a primary blank including a front panel, back panel, two side panels and at least one bottom panel;

cutting at least one supplementary blank including at least one central section and at least one auxiliary support extending from the central section; and affixing the at least one central section of the at least one supplementary blank to one of the panels of the primary blank to provide a pre-assembly for the container such that:

the at least one auxiliary support extends past a lateral edge of the one panel;

when the container is finally assembled, the at least one auxiliary support extends diagonally across a corner of the container formed by the one panel and an adjacent panel;

wherein cutting the at least one supplementary blank includes cutting two supplementary blanks each including at least one central section and at least one auxiliary support extending from the central section;

the affixing of the at least one central section of the at least one supplementary blank to one of the panels of the primary blank includes affixing the central section of each supplementary blank to a corresponding panel of the primary blank such that:

at least another one of the auxiliary supports for each supplementary blank extends past a lateral edge of the corresponding panel and is affixed to the corresponding panel; and when the container is finally assembled, the another one of the auxiliary supports for each supplementary blank is automatically formed and extends non-diagonally across a corner of the container formed by the corresponding panel and the adjacent panel.

24. A container pre-assembly comprising:

a primary blank including a front panel, back panel, two side panels and at least one bottom panel; and at least one supplementary blank including at least one central section and at least one auxiliary support extending from the central section, wherein the at least one central section of the at least one supplementary blank and one of the panels of the primary blank are affixed together such that:

the at least one auxiliary support extends past a lateral edge of the one panel;

when the container is finally assembled, the at least one auxiliary support extends diagonally across a corner of the container formed by the one panel and an adjacent panel;

further comprising a second supplementary blank, wherein each of the supplementary blanks includes at least one central section and at least one auxiliary support extending from the central section; and wherein the central section of each supplementary blank is affixed to a corresponding panel of the primary blank such that:

at least another one of the auxiliary supports for each supplementary blank extends past a lateral edge of the corresponding panel and is affixed to be corresponding panel; and when the container is finally assembled, the another of the auxiliary supports for each supplementary blank is automatically formed and extends non-diagonally across a corner of the container formed by the corresponding panel and the adjacent panel.

25. A plurality of blanks for a container pre-assembly, the plurality of blanks comprising:

a primary blank including a front panel, back panel, two side panels and at least one bottom panel; and at least one supplementary blank including at least one central section and at least one auxiliary support extending from the central section, wherein the primary blank is configured to mate with and be affixed with the at least one supplementary blank so that:

the at least one auxiliary support extends past a lateral edge of the one panel;

when the container is finally assembled, the at least one auxiliary support extends diagonally across a corner of the container formed by the one panel and an adjacent panel;

further comprising a second supplementary blank, wherein each of the supplementary blanks includes at least one central section and at least one auxiliary support extending from the central section; and wherein the central section of each supplementary blank is affixed to a corresponding panel of the primary blank such that:

at least another one of the auxiliary supports for each supplementary blank extends past a lateral edge of the corresponding panel and is affixed to the corresponding panel; and when the container is finally assembled, the another one of the auxiliary supports for each supplementary blank is automatically formed and extends non-diagonally across a corner of the container formed by the corresponding panel and the adjacent panel.

* * * * *